US012179996B2

(12) United States Patent
Cook et al.

(10) Patent No.: US 12,179,996 B2
(45) Date of Patent: Dec. 31, 2024

(54) MODULAR AUTO-CLEANING HOPPER ASSEMBLY

(71) Applicant: Dimension Product Solutions LP, Crosby, TX (US)

(72) Inventors: George T. Cook, Crosby, TX (US); Burt Lusk, La Porte, TX (US)

(73) Assignee: Dimension Product Solutions LP, Crosby, TX (US)

( * ) Notice: Subject to any disclaimer, the term of this patent is extended or adjusted under 35 U.S.C. 154(b) by 395 days.

(21) Appl. No.: 17/454,609

(22) Filed: Nov. 11, 2021

(65) Prior Publication Data

US 2023/0150758 A1 May 18, 2023

(51) Int. Cl.

| | |
|---|---|
| ***B65D 88/26*** | (2006.01) |
| ***B65D 90/00*** | (2006.01) |
| ***B65D 90/02*** | (2019.01) |
| ***E04B 1/19*** | (2006.01) |
| ***E04B 1/24*** | (2006.01) |
| ***E04H 7/30*** | (2006.01) |

(52) U.S. Cl.

CPC ..... *B65D 90/023* (2013.01); *B65D 88/26* (2013.01); *B65D 90/0093* (2013.01); *E04B 1/19* (2013.01); *E04B 1/24* (2013.01); *E04H 7/30* (2013.01); *E04B 2001/199* (2013.01)

(58) Field of Classification Search

CPC .. B65D 88/26; B65D 90/0093; B65D 90/023; E04B 1/19; E04B 1/24; E04B 2001/199; E04H 7/30

USPC ..... 52/194

See application file for complete search history.

(56) References Cited

U.S. PATENT DOCUMENTS

| | | | | |
|---|---|---|---|---|
| 1,311,296 | A * | 7/1919 | Poppenhusen et al. | B65D 88/26 52/197 |
| 1,456,654 | A * | 5/1923 | Strong | B65D 90/023 220/4.12 |
| 1,742,709 | A * | 1/1930 | Kenigsberg | B65D 88/28 105/247 |
| 2,563,470 | A * | 8/1951 | Kane | B65D 88/30 280/830 |
| 3,976,030 | A * | 8/1976 | Ragsdale | A01C 1/08 65/335 |
| 4,218,859 | A * | 8/1980 | Sams | E04H 7/30 52/745.01 |
| 5,566,470 | A * | 10/1996 | Morrison | F26B 17/124 34/174 |
| 7,392,624 | B2 * | 7/2008 | Kinzer | B65G 21/12 52/192 |
| 8,601,714 | B2 * | 12/2013 | Morrison | F26B 17/124 34/174 |

(Continued)

*Primary Examiner* — James J Buckle, Jr.

(74) *Attorney, Agent, or Firm* — Greer, Burns & Crain, Ltd.

(57) ABSTRACT

A modular hopper assembly is provided and includes a plurality of pre-fabricated upper hopper modular units, a plurality of pre-fabricated middle hopper modular units, a plurality of pre-fabricated lower hopper modular units and a plurality of support members configured as a base, where the upper hopper modular units, the middle hopper modular units and the lower hopper modular units are each assembled, and then the assembled upper hopper modular units, the assembled middle hopper modular units and the assembled lower hopper modular units are connected together to form a hopper, where the hopper is mounted on the base.

16 Claims, 20 Drawing Sheets

(56) References Cited

U.S. PATENT DOCUMENTS

| | | | | |
|---|---|---|---|---|
| 8,701,576 | B2 | 4/2014 | Friggstad | |
| 9,302,604 | B2 | 4/2016 | Thiessen | |
| 9,420,739 | B2 | 8/2016 | Rollenhagen | |
| D807,414 | S * | 1/2018 | Maguire | D15/135 |
| 9,963,293 | B2 * | 5/2018 | Pleima | B65D 88/66 |
| 10,138,075 | B2 * | 11/2018 | Maguire | B29B 7/603 |
| 10,287,091 | B2 * | 5/2019 | Allegretti | B65D 90/14 |
| 10,473,254 | B2 | 11/2019 | Tutor | |
| 10,538,381 | B2 * | 1/2020 | Harris | B65D 90/0033 |
| 10,807,792 | B2 * | 10/2020 | Froese | B65D 88/26 |
| 10,926,940 | B2 * | 2/2021 | Allegretti | B65D 19/08 |
| 2015/0314301 | A1 * | 11/2015 | Bergman | B02C 13/286 241/285.2 |
| 2017/0297830 | A1 * | 10/2017 | Donohoo | B65G 65/32 |
| 2020/0115150 | A1 * | 4/2020 | Froese | B65D 88/28 |
| 2022/0203940 | A1 * | 6/2022 | Schroeder | B65D 90/0093 |
| 2023/0013683 | A1 * | 1/2023 | Thiessen | B65D 88/32 |

* cited by examiner

DETAIL A

MODULAR AUTO-CLEANING HOPPER ASSEMBLY

BACKGROUND

The present application relates generally to a hopper for feeding raw materials to a manufacturing system, and more particularly to a modular, auto-cleaning hopper that is constructed with interconnected modular units that enable the hopper to transported and assembled easily and efficiently.

Conventional hoppers are typically large, pyramidal or cone-shaped containers used in industrial processes to hold particulate matter or a flow-able material such as dust, gravel, nuts, seeds or another raw material. Raw material is loaded into a hopper through an inlet at or near the top portion of the hopper. The raw material fills the hopper and is stored until needed for an industrial process. A hopper usually has angled interior walls to cause the raw material to flow downwardly towards an outlet at a bottom of the hopper. When the raw material is needed in the industrial process, the outlet is opened and the raw material flows out of the hopper through the outlet. Industrial hoppers are commonly made with stainless steel and are very large in size. Therefore, the materials for constructing the hopper are delivered to an industrial site and then the hopper is built at the site. Given the size of most industrial hoppers, the hoppers require significant time and money to transport and construct the hoppers at a site.

Furthermore, the interior of most hoppers accumulates dust and raw materials that stick to the inside surfaces of the hoppers. The dust and raw materials must be cleaned off of the inside surfaces when changing the raw material being stored in a hopper or to minimize contamination of new raw materials being loaded into the hoppers. Most hoppers have a door on the housing of the hopper that enables a person to access the interior of the hopper to clean the inside surfaces using a pressure washer, pressurized air or other cleaning methods. Cleaning hoppers in this way requires time and effort and also requires that the industrial process be stopped for a period of time during cleaning. As such, the cleaning process for hoppers increases the operating expense of the industrial process.

Therefore, it is desirable to provide a modular hopper that is easily transported and assembled at a desired location and that has an automatic cleaning system that efficiently removes dust and material debris from the interior of the hopper.

SUMMARY

The present hopper assembly is configured for receiving and storing raw materials and then supplying the raw materials to a manufacturing system, where the modular hopper assembly is constructed with multiple pre-fabricated modular units that enable the hopper assembly to be easily and efficiently transported and constructed at a site.

In an embodiment, a modular hopper assembly is provided and includes a plurality of pre-fabricated upper hopper modular units, a plurality of pre-fabricated middle hopper modular units, a plurality of pre-fabricated lower hopper modular units and a plurality of support members configured as a base, where the upper hopper modular units, the middle hopper modular units and the lower hopper modular units are each assembled, and then the assembled upper hopper modular units, the assembled middle hopper modular units and the assembled lower hopper modular units are connected together to form a hopper, where the hopper is mounted on the base.

In another embodiment, a method of assembling a modular hopper assembly at a site includes assembling a plurality of pre-fabricated upper hopper modular units as an assembled upper hopper structure, assembling a plurality of pre-fabricated middle hopper modular units as an assembled middle hopper structure, assembling a plurality of pre-fabricated lower hopper modular units as an assembled lower hopper structure and assembling a plurality of support members as a base unit. The method also includes connecting the assembled upper hopper structure, the assembled middle hopper structure and the assembled lower hopper structure to form a hopper, and mounting the hopper on the base unit.

DETAILED DESCRIPTION

The present hopper assembly is configured for receiving and storing raw materials and supplying the raw materials to a manufacturing system, and more particularly, to a modular hopper assembly constructed with multiple pre-fabricated modular units that form a hopper mounted on a base, where the pre-fabricated modular units enable the hopper assembly to be easily and efficiently transported and constructed at a site, such as within a commercial or industrial building or factory.

Figure 1:
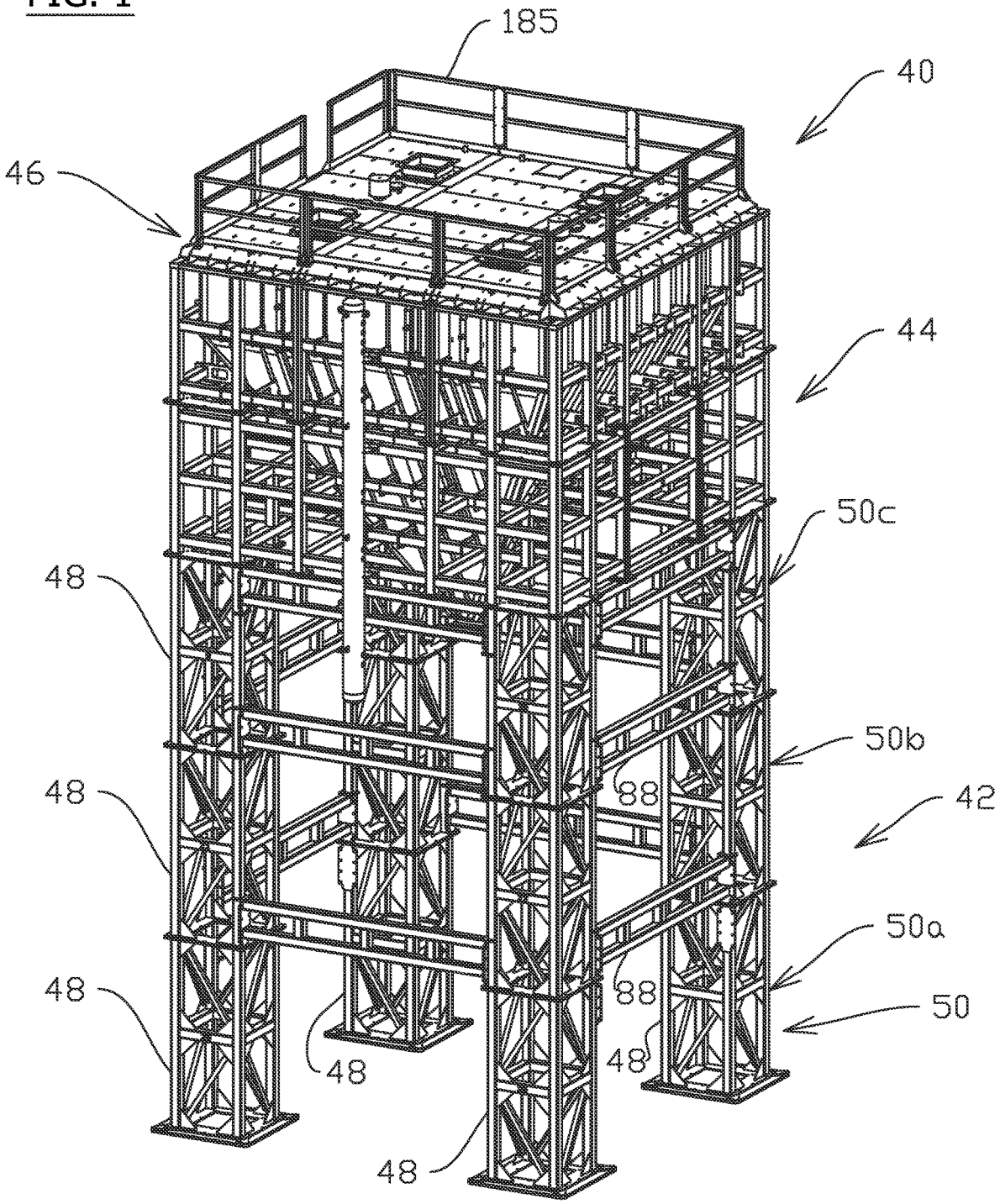
FIG. 1 is a perspective view of the present modular hopper assembly.
Figure 2:
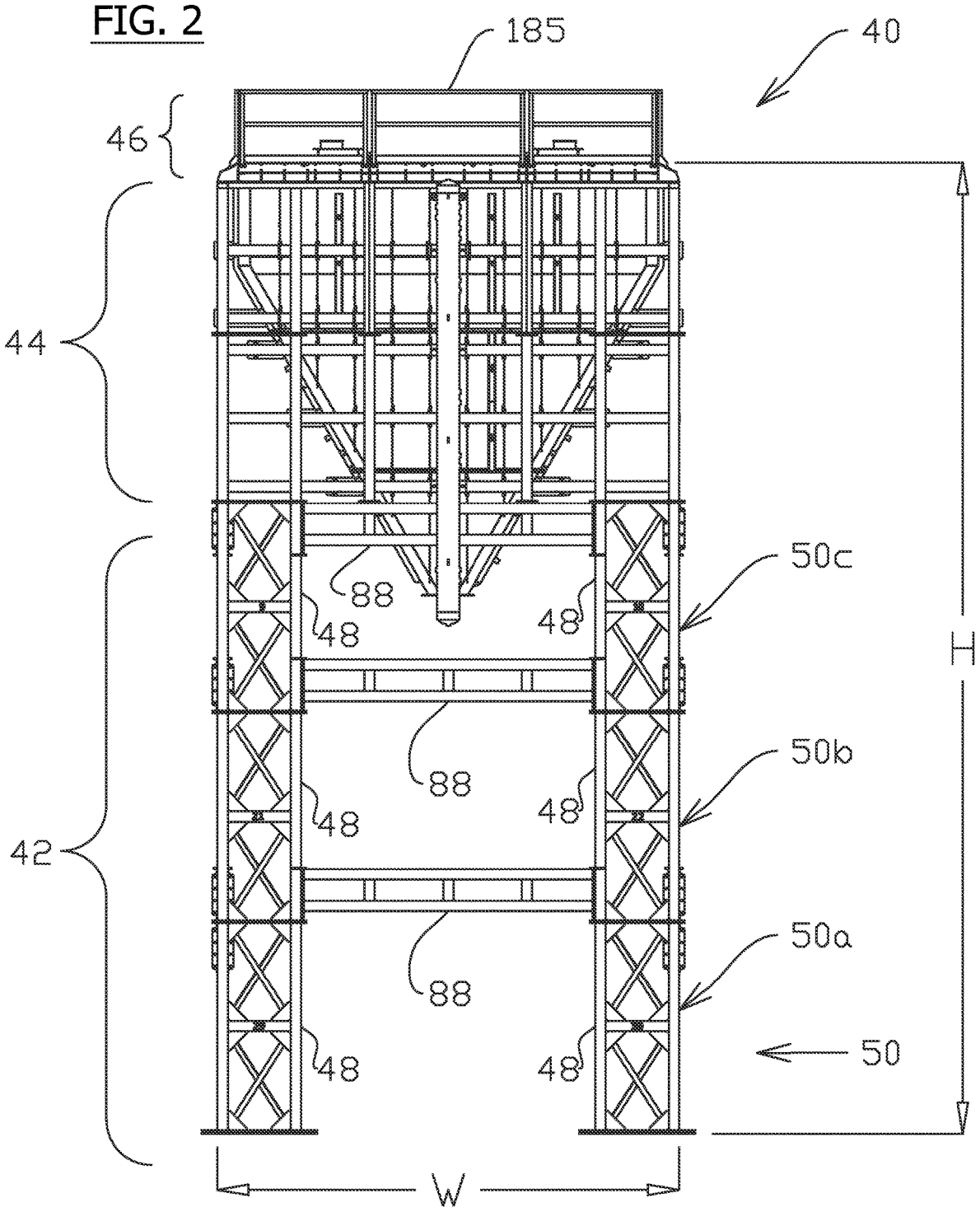
FIG. 2 is a side view of the modular hopper assembly of FIG. 1, where an opposing side view is a mirror image thereof.
Figure 3:
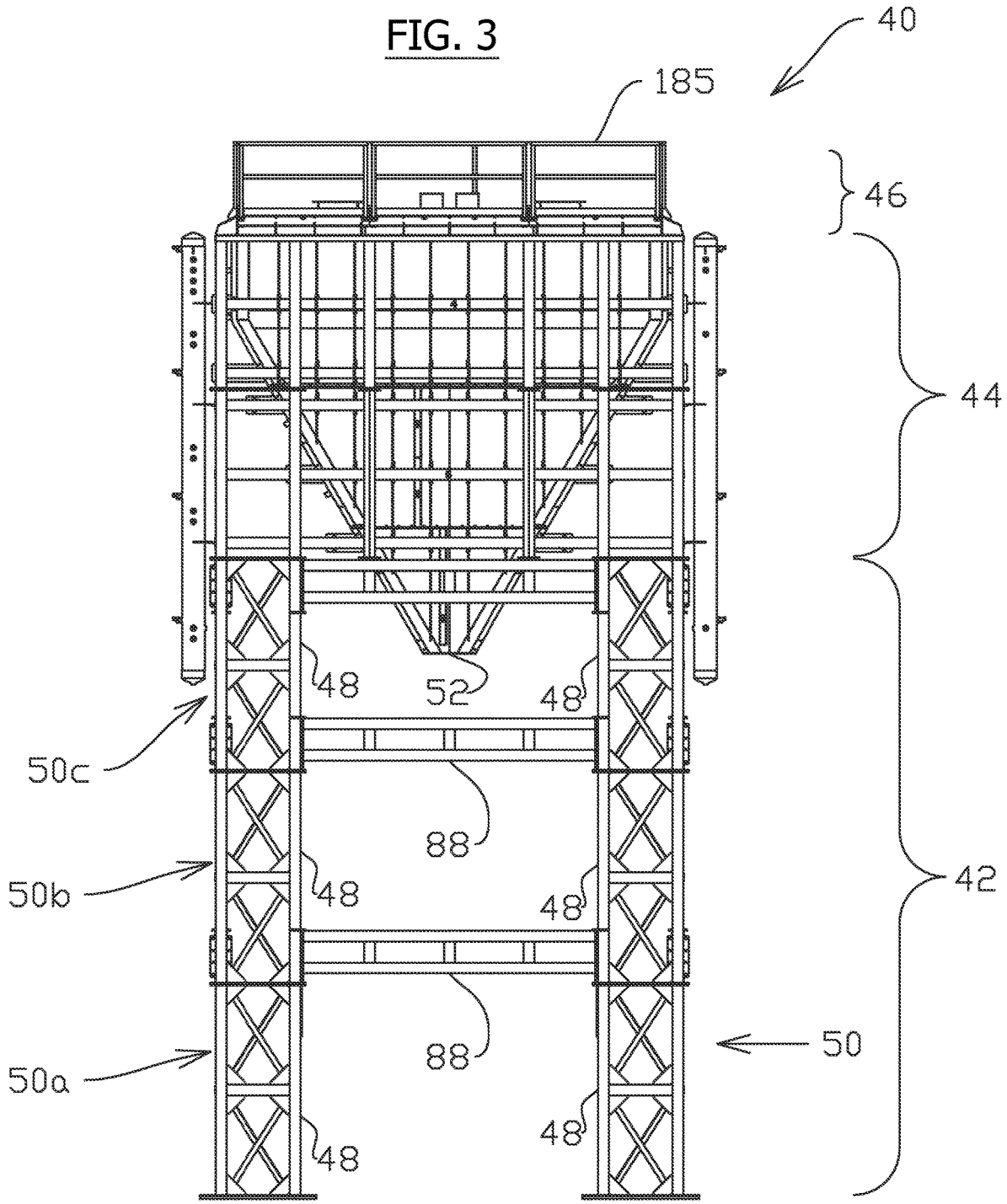
FIG. 3 is a side view, which is adjacent to the side shown in FIG. 2, where an opposing side view is a mirror image thereof.
Figure 4:
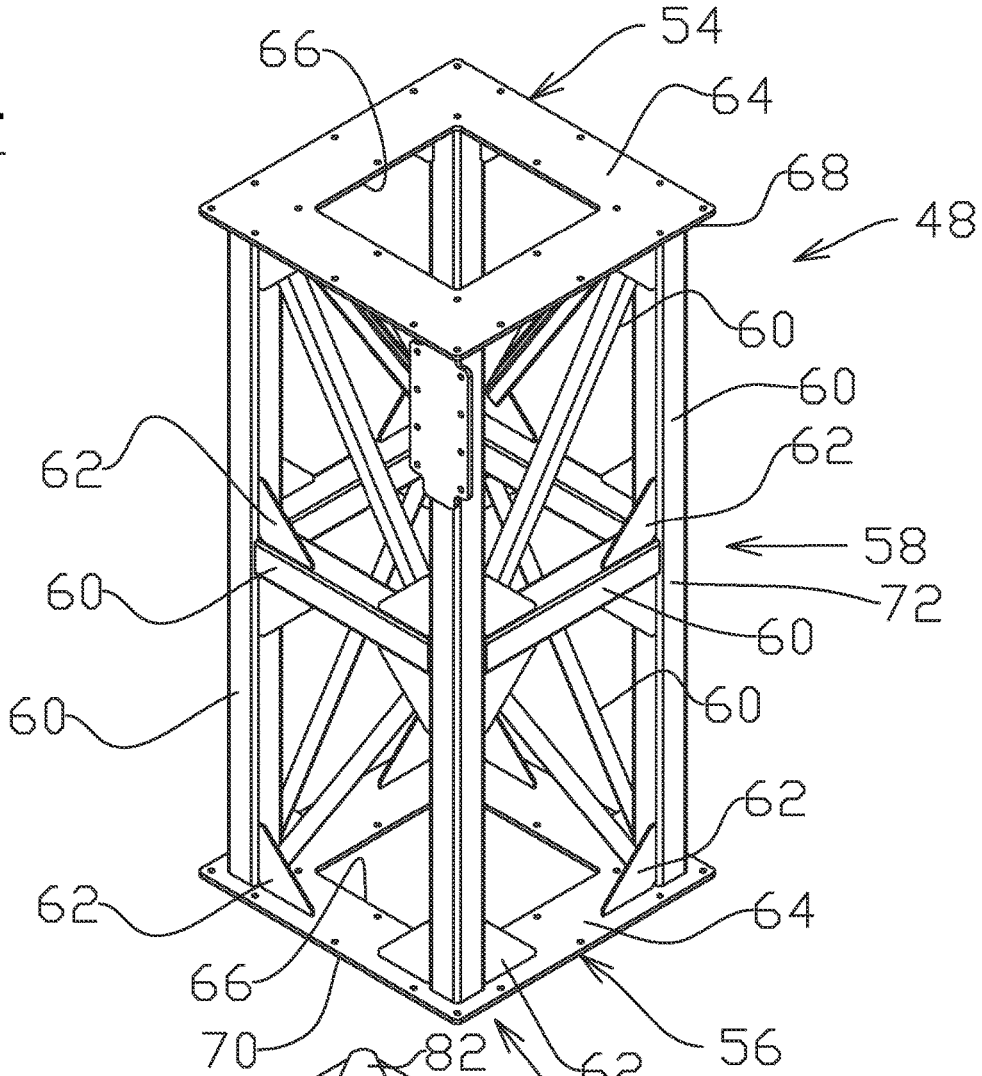
FIG. 4 is a perspective view of a base member of the modular hopper assembly of FIG. 1.

Referring now to FIGS. 1-3, the present modular hopper assembly 40 includes a base 42 that provides stability and supports the weight of the hopper assembly, a hopper 44 that receives, stores and supplies one or more raw materials, such as a granular material or powder or any free flowing dry bulk material, and a roof structure 46 that covers the hopper 44 and supports equipment associated with the hopper.

As shown in FIGS. 1-4, the base 42 includes a plurality of pre-fabricated support members 48 that are attached to each other to form one or more pre-fabricated base units 50 that support the hopper 44 at a designated height above an underlying support surface, such as the floor or ground. As shown in FIG. 1, a first base unit 50*a* includes four support members 48 that are spaced from each other at each corner of the hopper assembly 40. A second base unit 50*b* also includes four support members 48 that are spaced from each other and attached to the support members of the first base unit 50*a* as described below. A third base unit 50*c* includes four support members 48 that are spaced from each other and attached to the support members of the second base unit 50*b*. As described above, the base 42 supports the hopper 44 where the height of the hopper, and more specifically, the height of the outlet 52 of the hopper is determined based on the height of a transport vehicle, such as a truck, or a container, a conveyor belt or other piece of equipment associated with a manufacturing process, in which the raw material stored in the hopper 44 is to be supplied. Thus, the support members 48, i.e., base units 50, are attached to each other in a vertical direction to form the base 42, until the hopper is positioned at the desired height. In this regard, the number of support members 48 (base units) needed to construct the base 42 is based on the height of each of the support members, where the height of the support members 48 may be one foot, four feet, ten feet or any suitable height needed for construction of the hopper assembly 40.

Figure 5:
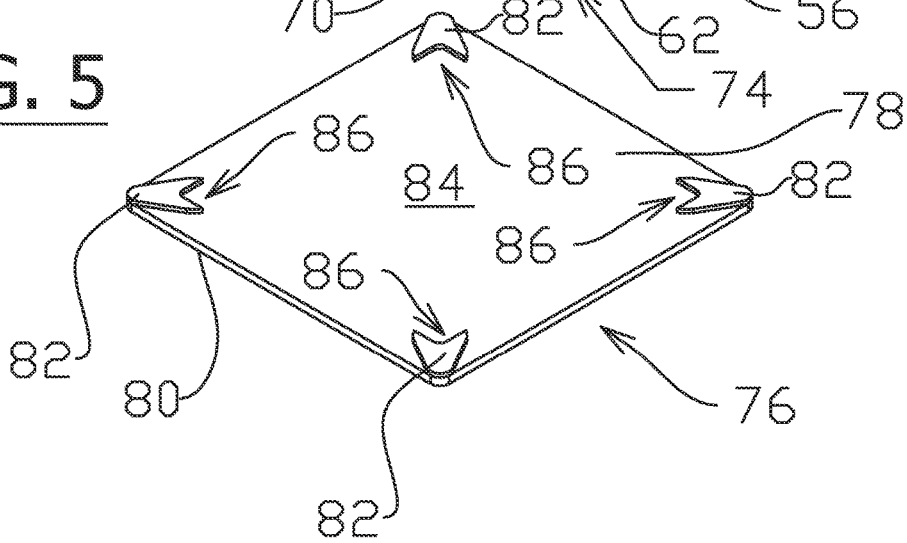
FIG. 5 is a perspective view of a base plate of the modular hopper assembly of FIG. 1.

In the illustrated embodiment, each support member 48 includes an upper plate 54 and a lower plate 56, where the upper plate and the lower plate are spaced apart and connected to each other by a support body 58 formed by a plurality of structural members 60 and brace plates 62. Preferably, the upper plate 54, the lower plate 56 and the support body 58 (structural members and brace plates) are attached to each other by welding, but may also be attached to each other using one or more connectors, such as rivets, bolts or screws, or any suitable connectors or attachment methods. The upper plate 54 and the lower plate 56 each include a square-shaped, planar base member 64 with a central through-hole 66. As shown, outer edge 68 of the upper plate 54 and the outer edge 70 of the lower plate 56 extend a distance beyond the outer surface 72 of the support body 58. In the illustrated embodiment, the bottom surfaces 74 of the support members 48 of the first base unit 50*a* of the base 42, are each attached to a base plate 76 shown in FIG. 5. Each base plate 76 includes a base member 78, which is planar and has a designated thickness, where the outer edge 80 extends beyond the outer edge 70 of the lower plate 56. Further, each base plate 78 includes four alignment tabs 82 on the upper surface 84 of the base plate, where the alignment tabs 82 each have indents 86 that correspond to the corners of the lower plate 56. In this way, the corners of the lower plate 56 are aligned with and placed in the indents 86 to align the support member 48 on the base plate 76. Each base plate 76 is then attached to the support members 48 by welding or another suitable attachment method. In this embodiment, the upper plate 54, the lower plate 56, the structural members 60 and the brace plates 62 of the support member 48 are preferably made of a metal, such as stainless steel, but may be made with a composite material, or any suitable material or combination of materials.

Figure 6:
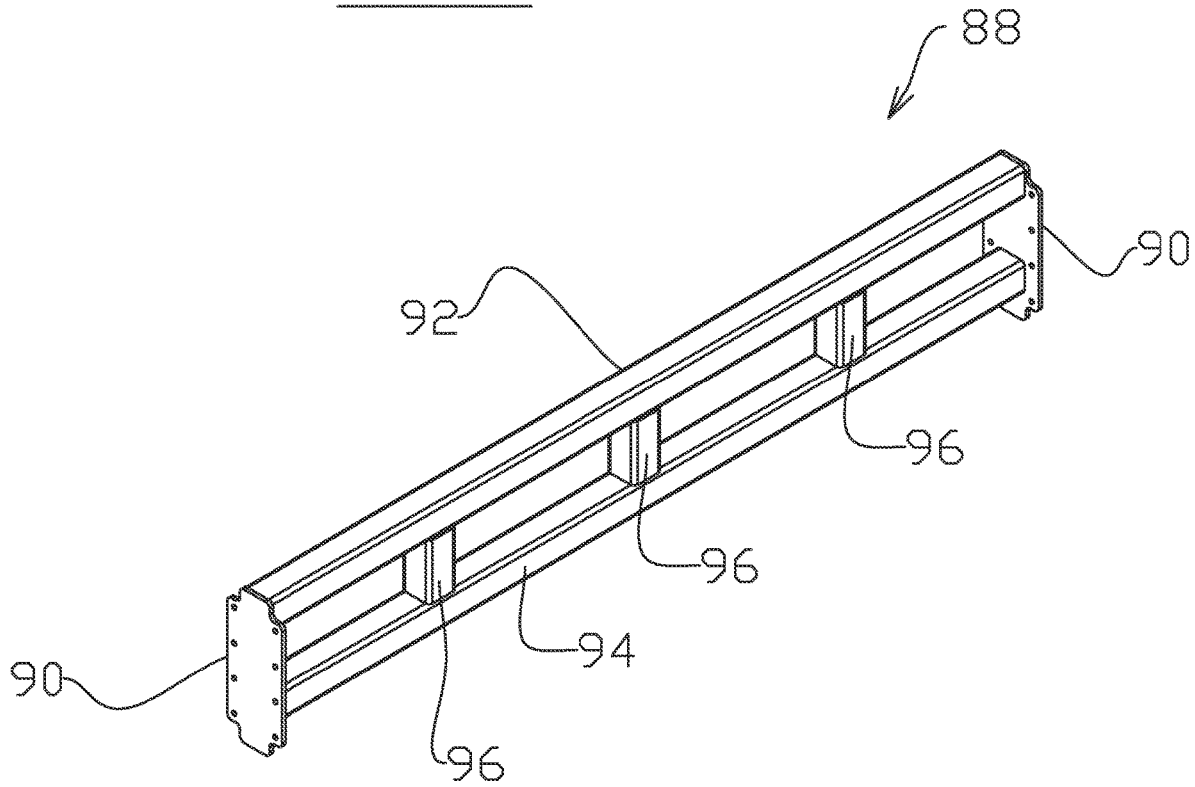
FIG. 6 is a perspective view of a support member of the modular hopper assembly of FIG. 1.

For additional support and stability, the base units that are mounted above the first base unit 50*a*, such as the second base unit 50*b* or the third base unit 50*c* shown in FIG. 1, each include cross supports 88 (FIG. 6) that are attached to the support members 48 of the base units 50*b* and 50*c*. The cross supports 88 each include opposing end plates 90, and a top member 92 and a bottom member 94 that are spaced from each other, where the top member and the bottom member extend between and are attached to the end plates 90. As shown, a plurality of intermediate members 96 are spaced from each other and are attached to the top member 92 and the bottom member 94. It should be appreciated that one cross support or a plurality of the cross supports 88 may be attached to the support members 48 of the base units 50. In this embodiment, the support members 48, the base plates 76 and the cross supports 88 are preferably made of a metal, such as stainless steel, but may be made with any suitable material or combination of materials.

Referring to FIGS. 7-17, the hopper 44 of the modular hopper assembly 40 includes pre-fabricated lower hopper units 98 (FIG. 7), pre-fabricated middle hopper units 100 (FIG. 8) and pre-fabricated upper hopper units 102 (FIG. 9), that are assembled together to form the hopper.

Figure 7:
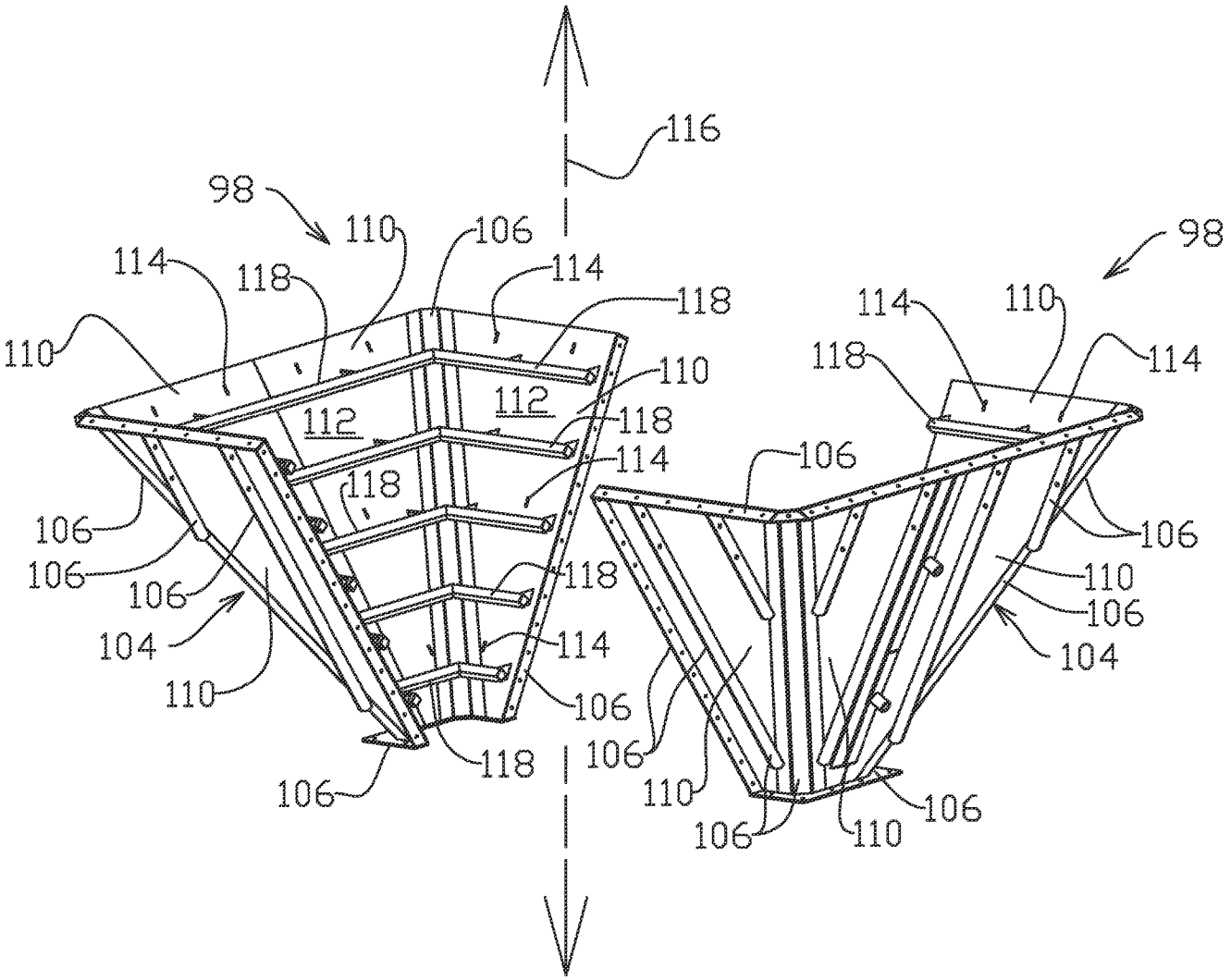
FIG. 7 is a perspective view of the lower hopper units of the modular hopper assembly of FIG. 1.
Figure 16:
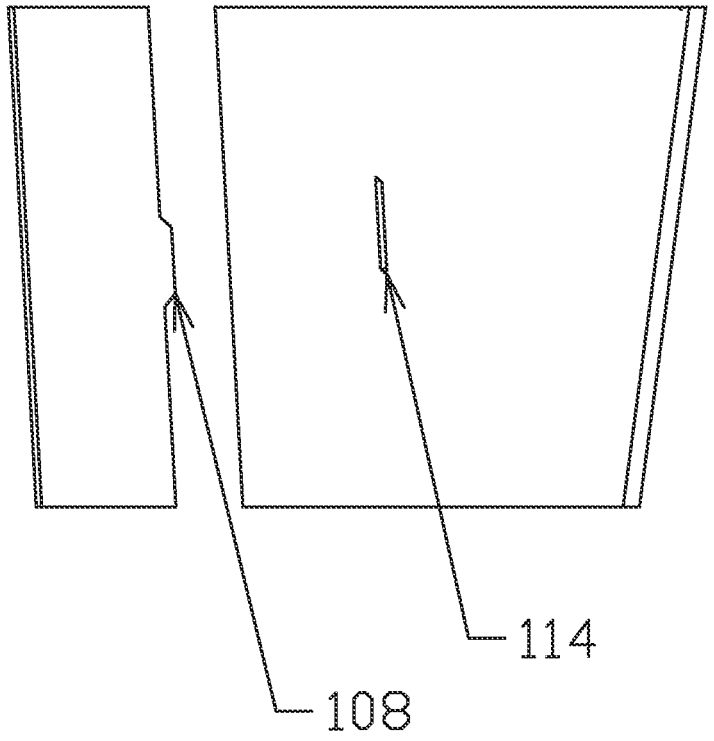
FIG. 16 is a fragmentary, side view of a support member of the panel frame and a panel.
Figure 17:
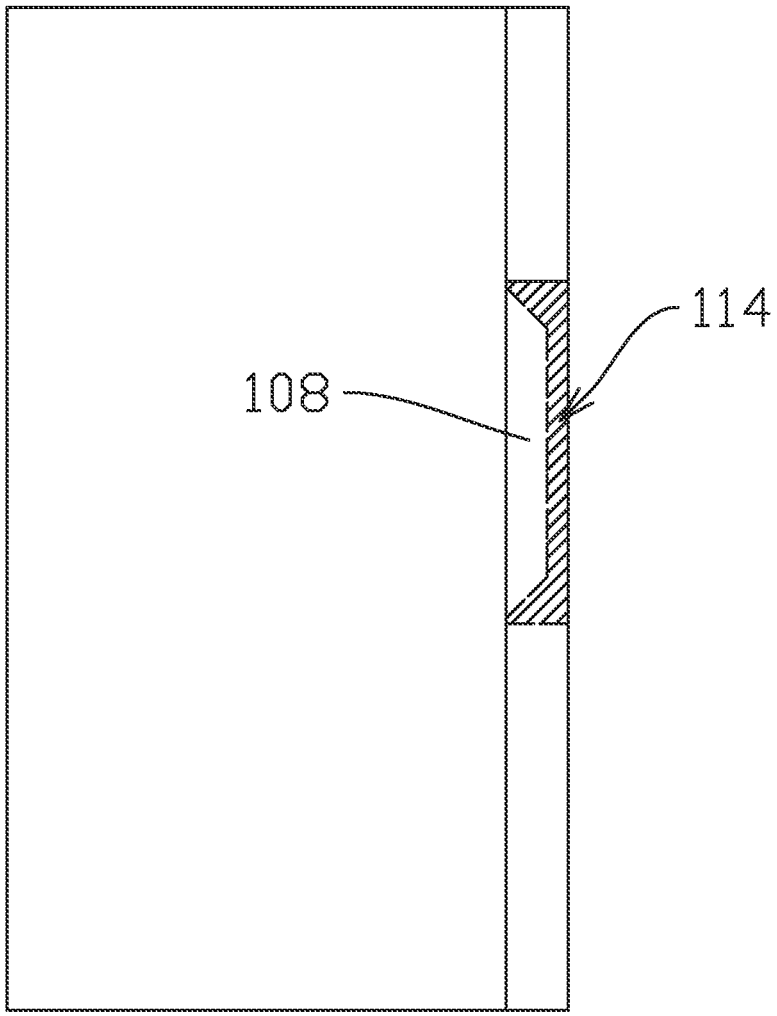
FIG. 17 is a fragmentary, enlarged cross-section view of a support member connected to a panel.

Referring to FIGS. 7, 16 and 17, the pre-fabricated lower hopper units 98 each include a frame 104 made of a plurality of support members 106 that are attached together by welding or another suitable attachment method, where the frame is the support structure for each of the lower hopper units. The frame 104 is preferably made of a metal, such as stainless steel, but may be made with a composite material, or any suitable material or combination of materials. In the illustrated embodiment, each of the support members 106 have a plurality of integrally formed tabs 108 that are spaced apart along the length of the support members. The tabs 108 extend a designated distance from the surface of the support members, and each have a generally trapezoidal shape. As shown in FIG. 7, a plurality of panels 110 each have a flat inner surface 112 and are attached to the frame 104 by aligning slots 114, i.e., through-holes, formed in the panels with corresponding tabs 108 on the support members of the frame as shown in FIG. 17. The connection of the tabs 108 with the slots 114 on the panels 110 enables the panels to be easily aligned with and attached to the frame 104. After the panels 110 are attached to the frame 104, the panels are secured to the frame by welding the tabs 108 to the panels 110 using a welding material. As shown in FIG. 7, the support members 106 of the frame 104 are positioned at a designated angle relative to a central longitudinal axis 116 of the hopper 44, and preferably at an angle of sixty degrees, so that the panels 110 of the lower hopper units 98 are also at an angle of sixty degrees, which promotes the funneling of a raw material toward the hopper outlet 52 while preventing the raw material from sticking to or residing on the inner surfaces of the panels 110. It should be appreciated that the support members 106 and the panels 110 may be positioned at any suitable angle relative to the longitudinal axis 116 of the lower hopper units 98.

As shown, a plurality of air supply devices 118 are attached to the inner surfaces 112 of the panels 110 of the lower hopper units 98 and oriented transverse to the longitudinal axis of the panels 110. The air supply devices 118 are spaced apart along the length of the panels 110 and emit or blow pressurized air on the inner surfaces 112 of the panels 110 of the lower hopper units as described below. In this embodiment, the lower hopper units 98 are attached to each other preferably by connectors such as bolts, washers and nuts or other suitable connectors so that welding at a site is not required. It should be appreciated that the lower hopper units 98 may also be connected together by welding or any suitable attachment method.

Figure 8:
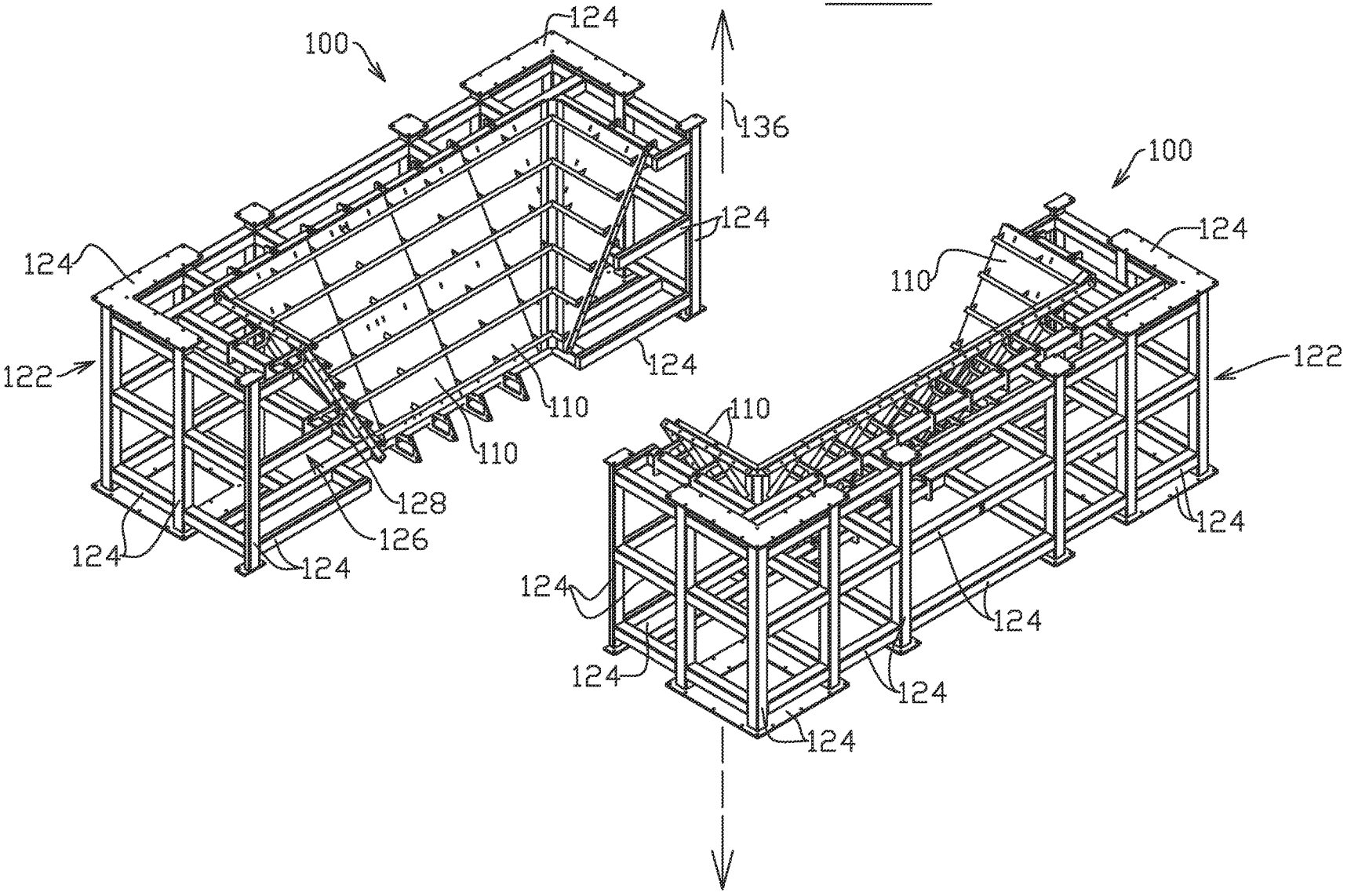
FIG. 8 is a perspective view of the middle hopper units of the modular hopper assembly of FIG. 1.
Figure 10:
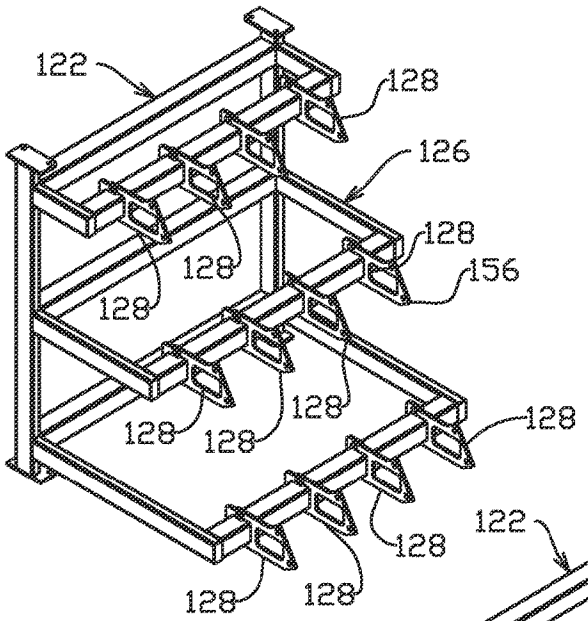
FIG. 10 is a perspective view of a hopper frame of the middle hopper units of FIG. 8.
Figure 15:
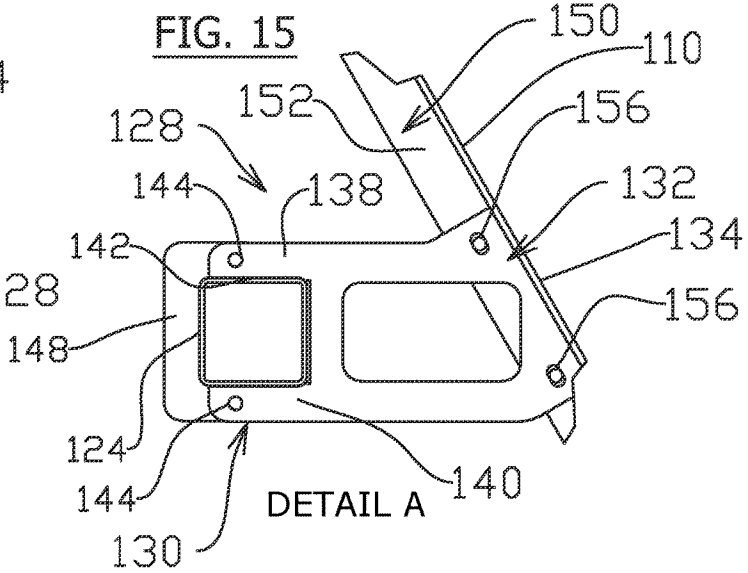
FIG. 15 is a side view showing the bracket of the panel frame attached to the hopper frame.

Referring to FIGS. 8 and 10-17, the middle hopper units 100 are pre-fabricated modular units that each include a frame 122 made with a plurality of support members 124 that are attached together by welding or another suitable attachment method. The frame 122 is preferably made of a metal, such as stainless steel, but may be made with a composite material, or any suitable material or combination of materials. As shown in FIGS. 8 and 10, an inner structure 126 of the frame 122 includes a plurality of panel brackets 128 that a spaced from each other and have an inner end 130 attached to one of the support members 124 and an outer end 132 having a surface 134 configured at an angle relative to the central longitudinal axis 136, where the angle is preferably sixty degrees as described above. More specifically, the inner ends 130 of the brackets 128 each have an upper arm 138 and a lower arm 140 that define a square-shaped opening 142, where the upper and lower arms extend over the upper and lower surfaces of one of the support members 124 of the frame 122 so that the support member fits into the opening 142 and the bracket contacts at least three sides of the support member as shown in FIG. 15. In the illustrated embodiment, the upper and lower arms 138, 140 each have a connector hole 144 that aligns with corresponding holes 146 on the frame brackets 148 of the support members 124. In this way, the brackets 128 may be connected to the frame brackets 148 by connectors, such as bolts, washers and nuts, or screws, or welded to the frame brackets. Similarly, the support members 124 are preferably welded to the brackets 128 to further secure the brackets 128 to the frame 122.

Figure 11:
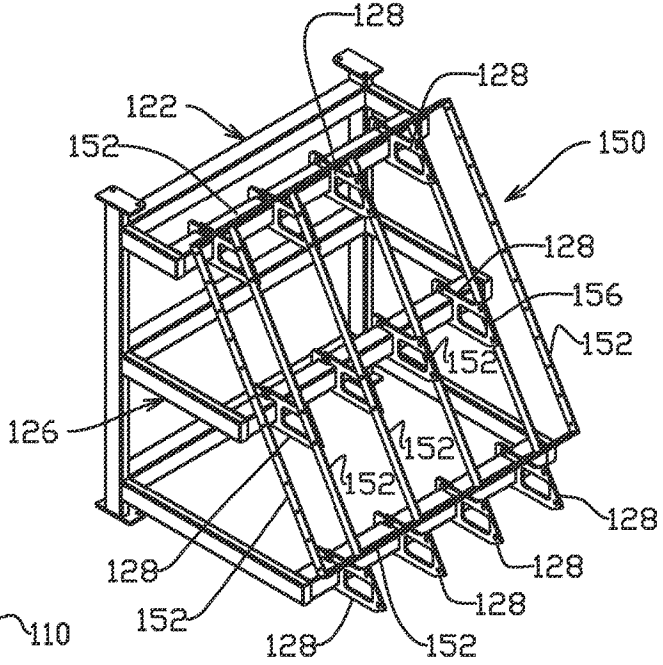
FIG. 11 is a perspective view of the hopper frame of FIG. 10 and a panel frame attached to the hopper frame.
Figure 13:
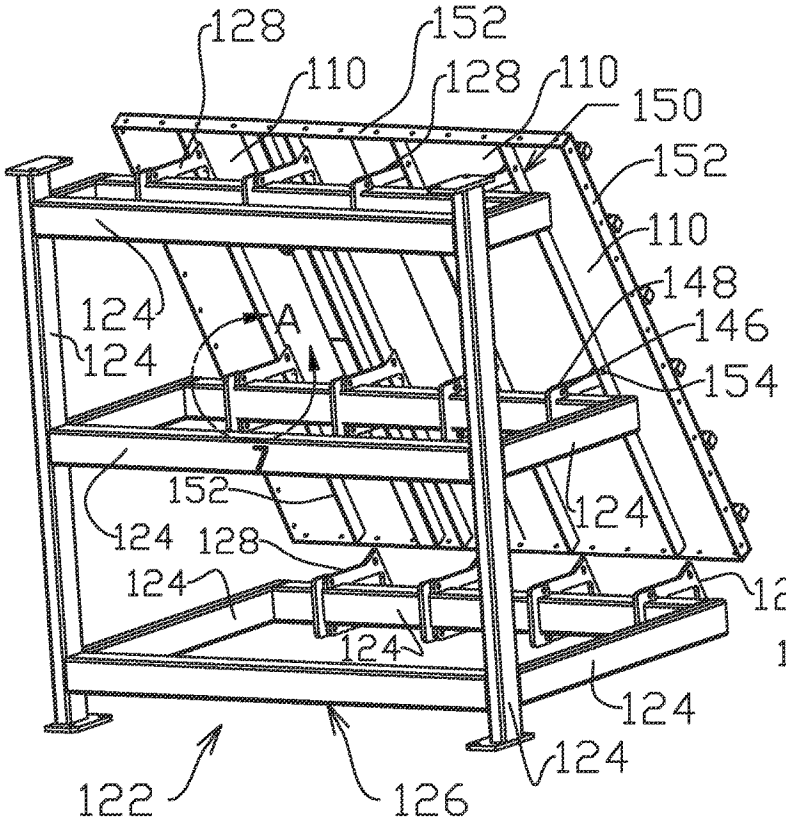
FIG. 13 is a perspective view of the hopper frame, the panel frame and panels assembled together.

Referring to FIGS. 11, 13 and 15, a panel frame 150 includes a plurality of support members 152 that are attached together by welding or other attachment method, and support panels 110 of the hopper 44. The panel frame 150 is preferably made of a metal, such as stainless steel, but may be made with a composite material, or any suitable material or combination of materials. In the illustrated embodiment, the support members 152 of the panel frame 150 each include through-holes 154 that align with corresponding through-holes 156 formed in the outer ends 132 of the brackets 128 as shown in FIG. 15. In this way, the support members 152 and the panel frame 150 are secured to each other by bolts, washers and nuts, and enable the panel frame to be easily and quickly aligned and secured on the frame 122. After the panel frame 150 is attached to the frame 122, the outer ends 132 of the brackets 128 may be further secured to the panel frame by welding the support members 152 to the brackets 128 using a welding material or by another suitable attachment method.

Figure 12:
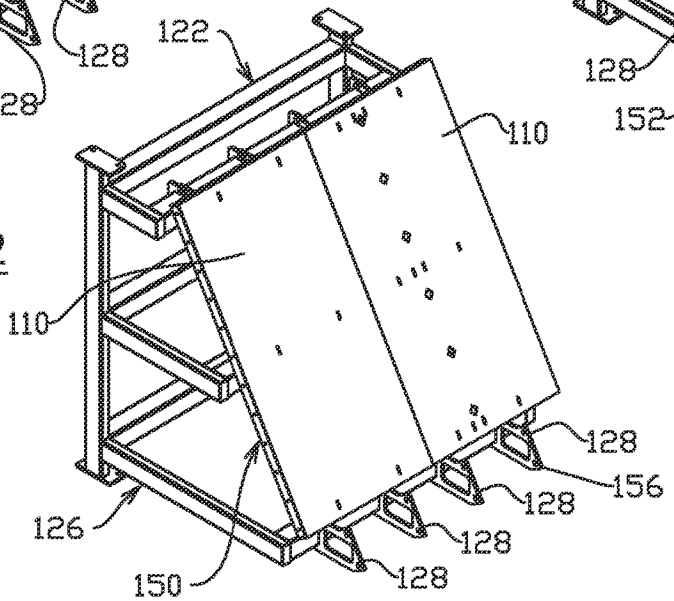
FIG. 12 is a perspective view of panels attached to the panel frame of FIG. 11.
Figure 14:
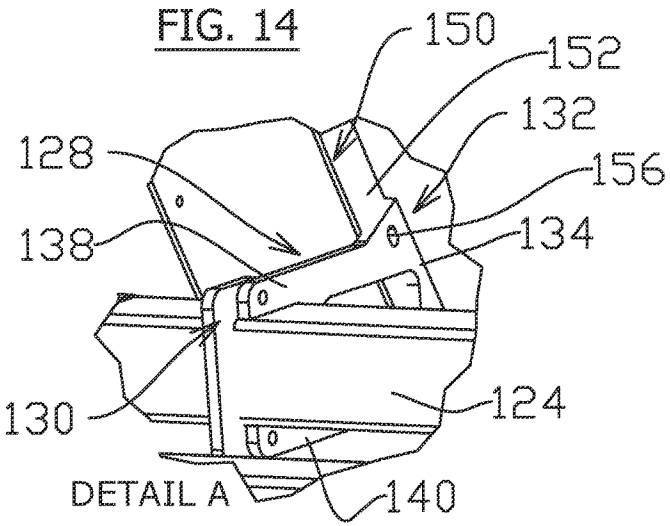
FIG. 14 is an enlarged, fragmentary perspective view showing a bracket of the panel frame attached to the hopper frame of FIG. 13.

Referring to FIGS. 12, 16 and 17, panels 110 are secured to the panel frame 150 by aligning slots 114 formed in the panels with corresponding tabs 108 on the outer ends of the brackets 128. The connection of the tabs 108 to the slots 114 in the panels 110 enables the panels to be quickly and easily positioned on the panel frame 150 and initially secured in place by tack welding. Additional welding is performed on the tabs 108 and slots 114 to fix the panels 110 on the panel frame 150. Similar to the lower hopper units 98, the middle hopper units 100 include a plurality of air supply devices 118 that extend transversely to the longitudinal inner surfaces of the panels 110. As shown, the air supply devices 118 are spaced apart and are configured to receive and emit pressurized air directed at the inner surfaces of the panels 110. In this embodiment, the middle hopper units 100 are attached to each other preferably by connectors such as bolts, washers and nuts, or other suitable connectors so that welding at a site is not required. It should be appreciated that the middle hopper units 100 may also be connected together by welding or any suitable attachment method.

Figure 9:
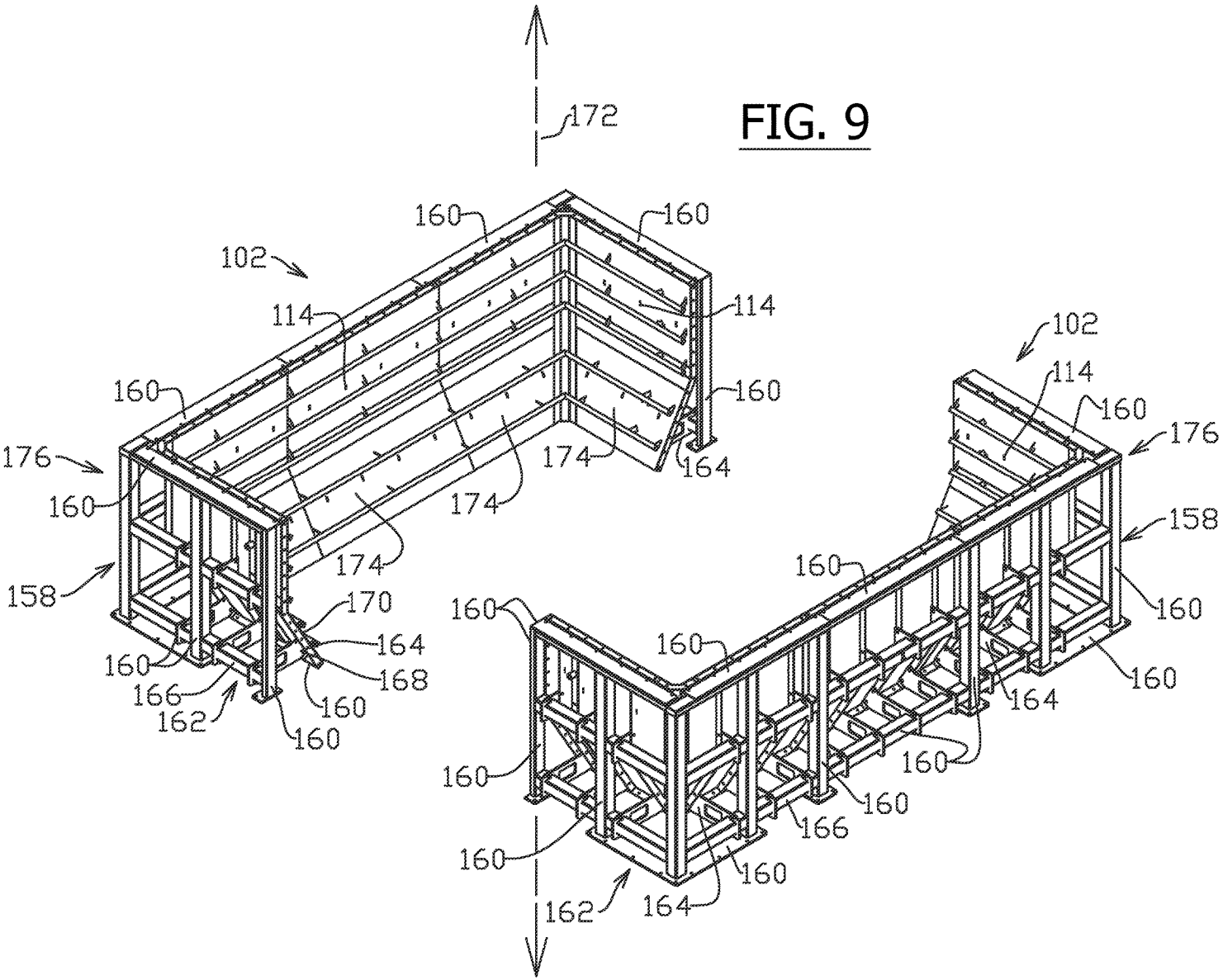
FIG. 9 is a perspective view of the upper hopper units of the modular hopper assembly of FIG. 1.

Referring to FIG. 9, the upper hopper units 102 have a similar construction to the middle hopper units 100, and include a frame 158 made with support members 160 that are interconnected by welding. The frame 158 is preferably made of a metal, such as stainless steel, but may be made with a composite material, or any suitable material or combination of materials. In this embodiment, a lower part 162 of the frame 158 includes a plurality of the spaced brackets 164 that are attached to a lower support member 166 as described above. The outer ends 168 of the brackets 164 have a surface 170 configured at an angle relative to the central longitudinal axis 172 of the hopper 44, where the angle is preferably sixty degrees, but may be any suitable angle. A plurality of lower panels 174 are secured to the brackets 164 as shown in FIGS. 16 and 17 as described above. The lower panels 174 are positioned at an angle of sixty degrees corresponding to the angle of the surfaces of the outer ends 168 of the brackets 164 and to the angled panels 174 of the middle hopper units 100 and the lower hopper units 98. The upper part 176 of the frame 158 is vertically oriented and a plurality of upper panels 178 are secured to this part of the frame 158 by the tabs 108 and slots 114 shown in FIGS. 16 and 17. After the upper hopper units are assembled, the upper hopper units 102 are attached to each other preferably by connectors such as bolts, washers and nuts or other suitable connectors so that welding at a site is not required. It should be appreciated that the upper hopper units 102 may also be connected together by welding or any suitable attachment method.

Figures 18A, 18B:
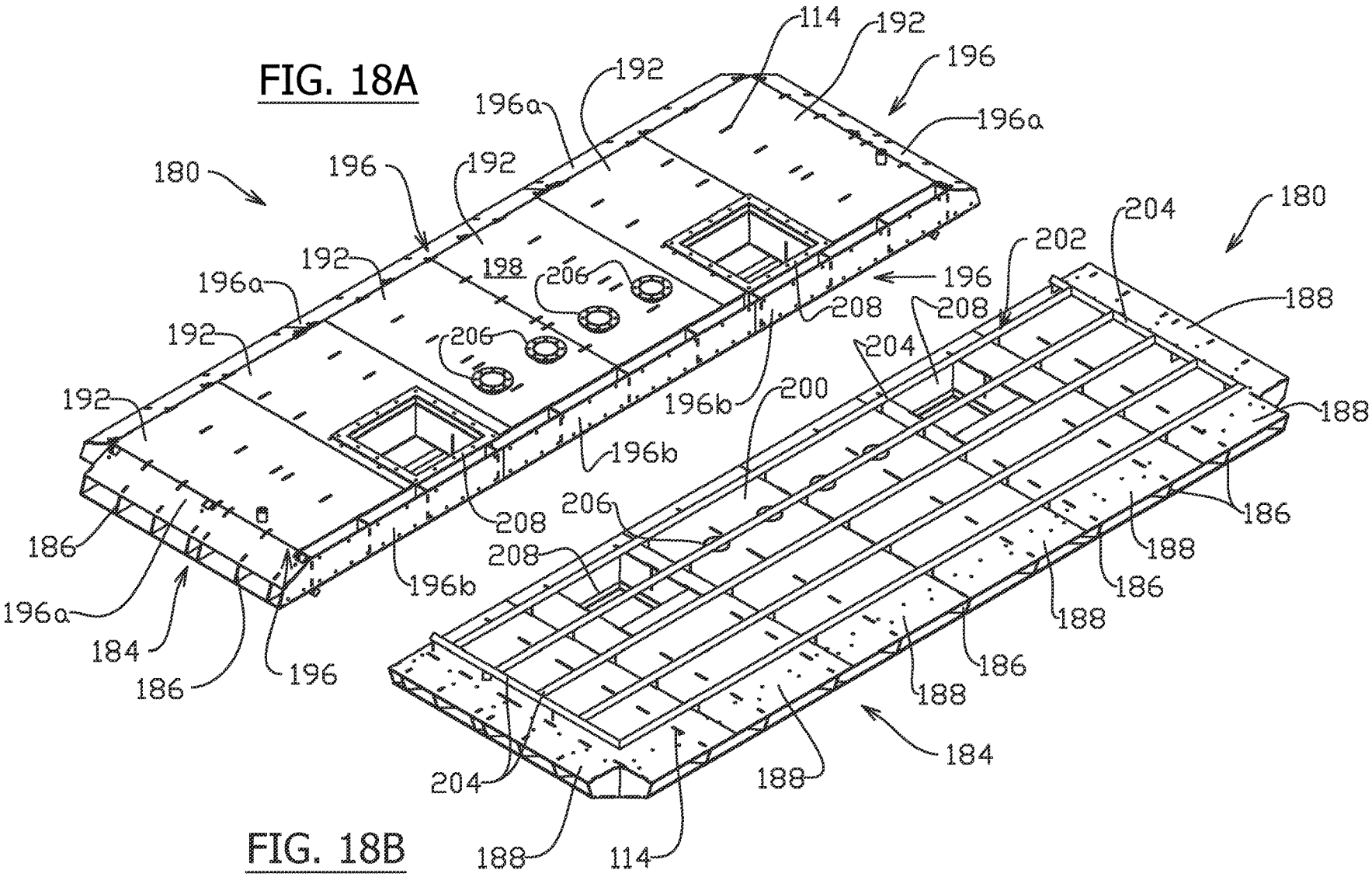
FIG. 18A is a top perspective view of a side roof unit of the modular hopper assembly of FIG. 1.
FIG. 18B is a bottom perspective view of the side roof unit of FIG. 18A.
Figures 19A, 19B, 19C:
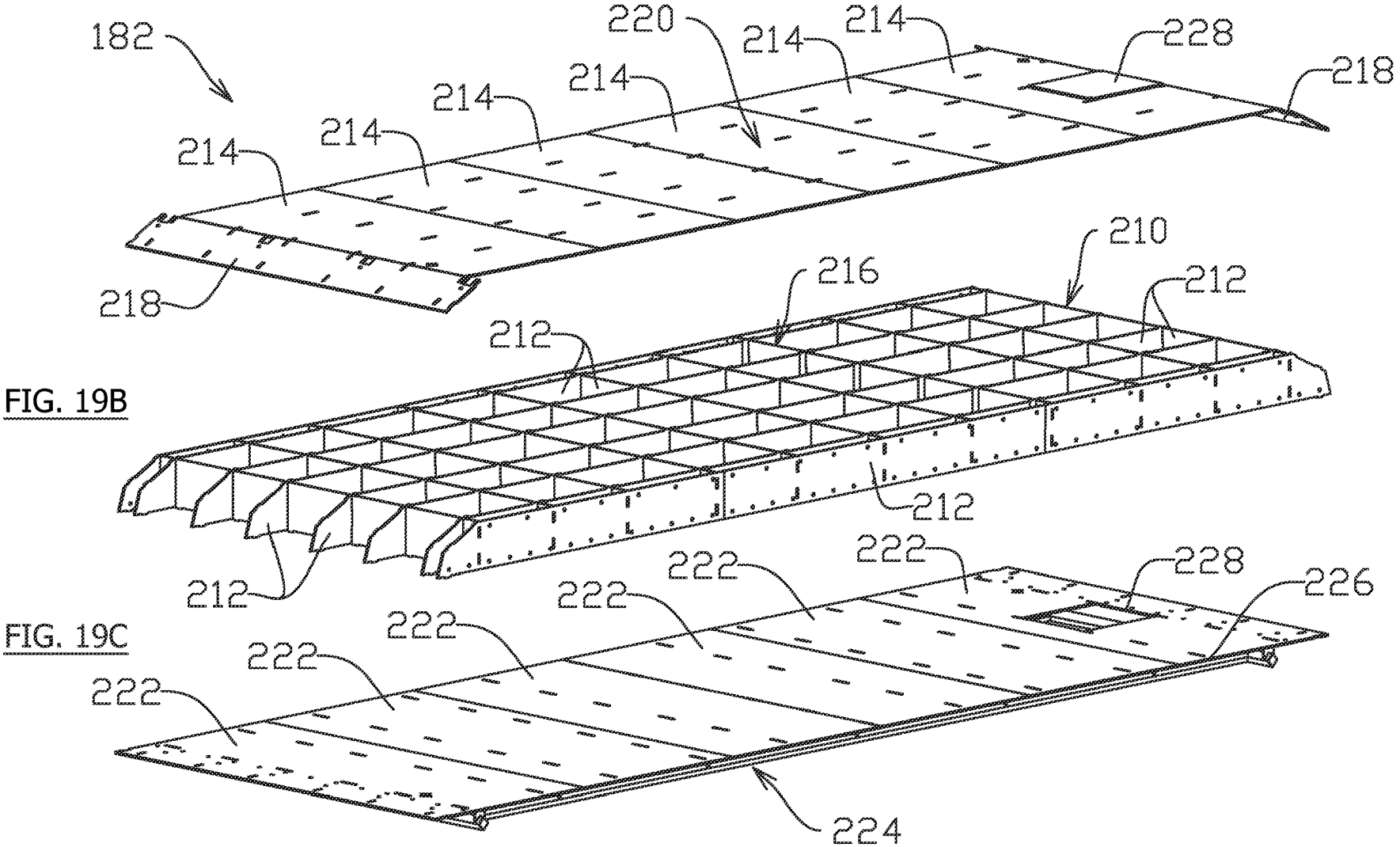
FIG. 19A is a perspective view of a plate assembly of a central roof unit of the modular hopper assembly of FIG. 1.
FIG. 19B is a perspective view of a roof frame of the central roof unit of the modular hopper assembly of FIG. 1.
FIG. 19C is a perspective view of a base plate assembly of the central roof unit of the modular hopper assembly of FIG. 1.

The roof structure 46 of the modular hopper assembly 40 includes pre-fabricated side roof units 180 as shown in FIGS. 18A and 18B, and pre-fabricated central roof units 182 as shown in FIGS. 19A, 19B and 19C. The side roof units 180 each include a frame 184 made with support members 186 that are interconnected by welding or another suitable attachment method. A plurality of base panels 188 are attached to a lower surface 190 of the frame 184 and a plurality of outer panels 192 are attached to an upper surface 194 of the frame 184. The base panels 188 and the outer panels 192 are each attached to the support members 186 of the frame 184 by aligning slots 114 in the outer panels 192 and base panels 188 with integrally formed tabs 108 on the support members 186 of the frame as described above. Similarly, a plurality of side panels 196 are attached to the perimeter of the frame 184 by the connection of the tabs 108 on the support members 186 with the slots 114 in the side panels. As shown in FIG. 18A, the outer panels 192 form a generally flat upper surface 198, the outer side panels 196*a* are slanted at an angle and the inner side panels 196*b* are vertically oriented. A bottom surface 200 of each side roof unit 180 includes a connection frame 202 formed with support members 204 that enable the side roof units 180 to be attached to the top surfaces of the upper hopper units 102 by welding or another suitable attachment method. In the illustrated embodiment, one or more of the side roof units 180 include inlet ports 206 and one or more air vents 208. It should be appreciated that the side roof units 180 may include one or a plurality of the inlet ports 206 and air vents 208.

Referring to FIGS. 19A, 19B and 19C, the roof structure 46 includes one or more central roof units 182 that are each connected between the side roof units 180 as described below. Each of the central roof units 182 includes a frame 210 made with a plurality of support members 212 that are interconnected in a grid pattern by welding. A plurality of outer panels 214 are attached to an upper surface 216 of the frame 210 by the tab and slot connections described above. Similarly, end panels 218 are connected to the opposing ends of the frame 210 by the tab and slot connections. As shown, the outer panels 214 form a generally flat surface 220 and the end panels 218 are positioned at an angle relative to the outer panels. A plurality of base panels 222 are attached to a lower frame 224 where the lower panels are attached to an upper surface 226 of the frame 224 by the tab and slot connections described above. In this embodiment, the central roof unit 182 includes an air vent 228 but may include one or a plurality of air vents or one or more access panels to the interior of the hopper 44. After being assembled, each of the central roof units 182 are attached to the upper surface of the upper hopper units 102 by welding or another suitable attachment method. In this embodiment, the panels and the support members of the side roof units and the central roof unit or units are preferably made of a metal, such as aluminum, but may be made out of any suitable material or combination of materials. Preferably, the roof structure (the top of the hopper) has a length of at least 22 feet by a width of at least 22 feet to provide a stable, safe platform for equipment placed on the roof structure. It should be appreciated that the roof structure may have any suitable length and width.

Figures 26, 27:
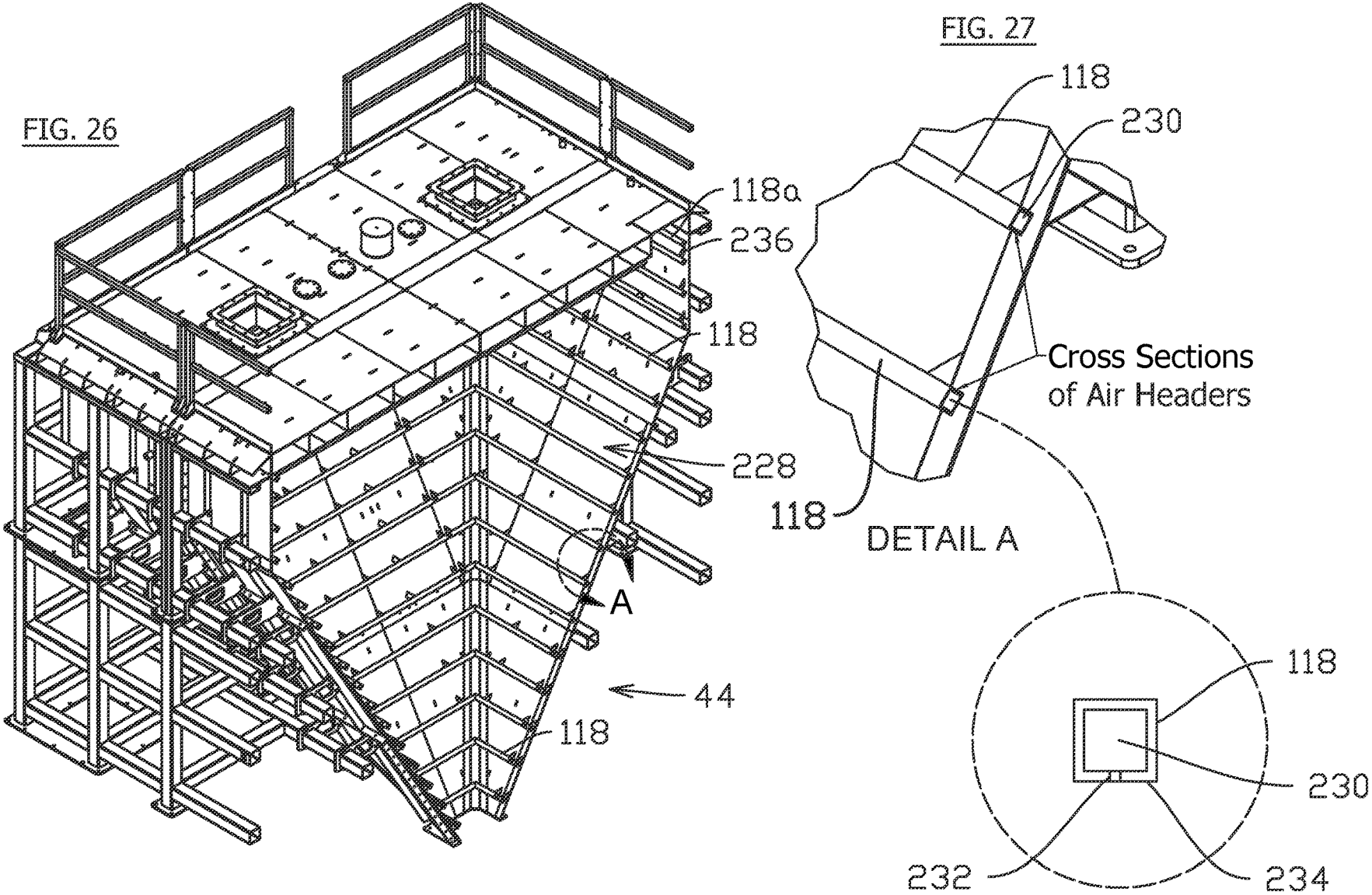
FIG. 26 is a fragmentary, perspective view of the hopper showing the auto-cleaning system.
FIG. 27 is an enlarged, fragmentary perspective view the air supply devices of the hopper.

Referring to FIGS. 26 and 27, in the above embodiment, an air cleaning system 228 is built into the hopper 44 is configured to remove dust, raw material and other material debris that may remain on the inner surfaces of the hopper. Cleaning the inner surfaces of the hopper 44 is critical for maintaining material quality and integrity and preventing cross contamination between different raw materials stored in the hopper. Further, larger hoppers are typically cleaned manually, which requires a person to access the interior of the hopper, which can be time consuming and dangerous. The present air cleaning system 228 fully automates the cleaning process, which overcomes the above issues, and cleans the inner surfaces of the hopper 44 in a much shorter amount of time, i.e., minutes instead of hours.

In this embodiment, the air supply devices 118 of the air cleaning system 228 are mounted on the inner surfaces of the panels of the hopper 44 and each have a square cross-sectional shape that defines a hollow interior space 230. Each of the air supply devices 118 are mounted on the inner surfaces of the hopper 44 so that there are no flat surfaces on the air supply devices for collecting dust, raw material or other debris. Further, the air supply devices 118 are each connected to a pressurized air source that may be located on the top surface of the roof structure 46 or another suitable location. A plurality of spaced openings or nozzles 232 are formed in a bottom surface 234 of the air supply devices 118 and are configured to direct pressurized air from the hollow interior space 230 at the inner surfaces of the panels of the hopper 44 to help clean dust, raw materials and other debris from the inner surfaces. Additionally, the topmost air supply device 118*a* in the upper hopper units 102 includes a top surface 236 with openings or nozzles 232 directed toward the ceiling of the hopper 44 to help remove and clean raw material from the ceiling of the hopper. In another embodiment, the topmost air supply device 118*a* includes openings or nozzles that are on the upper and lower surfaces of the air supply device to direct pressurized air toward the ceiling and toward the inner surfaces of the hopper. It should be appreciated that one of the air supply devices or a plurality of the air supply devices 118 may direct pressurized air toward the ceiling of the hopper. In this embodiment, the air supply devices 118 automatically direct pressurized air at the inner surfaces and ceiling of the hopper 44 at a designated time or times. In an embodiment, the air supply devices 118 are coupled to a timer associated with a controller or processor that sends a signal to the air supply devices to operate at the designated time or times. In another embodiment, the air supply devices 118 are coupled an integrated control system in a control room and controlled by an operator During a cleaning cycle, pressurized air or compressed air is introduced into the air supply devices 118 by an air solenoid valve. The pressurized air is directed out of the openings 232 in the air supply devices at the hopper's interior surfaces, thereby blowing dust, raw material and other debris downward toward the outlet 52. Similarly, at least the topmost air supply device 118*a* directs pressurized air at the ceiling of the hopper 44 to dislodge dust and other materials from the ceiling. The air supply devices 118 are supplied with pressurized air from one or more air manifolds, where the air manifolds allow for air accumulation close to the air cleaning system 228 and are part of the air distribution system in which air solenoid valves feed the air supply devices. As described above, the panels (inner walls) of the hopper 44 are configured at an angle of sixty degrees, which is sufficient for mass flow of most raw materials and facilitates thorough cleaning of dust, raw materials and other debris from the inner surfaces of the hopper.

In operation, a valve on the outlet 52 to the hopper 44 is closed and a vacuum pump or air blower is started. One or more valves on the ceiling (roof structure) of the hopper 44 are opened to allow air to be pulled through the hopper from filtered vents located at the top of the hopper. Next, the air supply devices 118 are sequentially actuated from the top to the bottom of the hopper 44 to dislodge dust and other materials from the inner surfaces of the hopper and into the vacuum air stream toward the outlet 52. This cleaning cycle may be performed repeatedly during each cleaning of the hopper 44 as needed to sufficiently clean the interior of the hopper and meet the level of cleaning required to prevent cross contamination of the raw materials stored in the hopper. Upon completion of the cleaning process, the vacuum pump and/or air blower is shut off and the outlet 52 is re-opened.

Referring to FIGS. 20-25, the pre-fabricated modular units of the modular hopper assembly 40 described above are configured to be shipped globally via standard and high cube forty foot ISO shipping containers on transportation vehicles, such as flatbed trailers or railcars, or dry vans. No crating or excessive dunnage (shipping containers or packaging) is required to safely ship the modular units to a site. Further, the modular units 98, 100 and 102 are configured to be at or below regulatory weight limitations for shipping containers and/or the vehicles that transport the modular units. In this way, the modular units 98, 100 and 102 are designed and constructed in a size that maximizes shipping efficiency, expedites and facilitates assembly at a site, and enables assembly in buildings, or other structures, that do not have large ports of access and without forming or cutting openings in a part of a building structure such as in a wall or roof of a building. The modular configuration of the hopper units also allows for easy modification of portions of the hopper assembly 40 without changing or replacing the entire hopper assembly.

After the modular units 98, 100 and 102 for the hopper assembly 40 are shipped to a site, the modular units are assembled to construct the hopper assembly 40 at the site. In the illustrated embodiment, the modular hopper assembly 40 is constructed at the site using a "bottom up" construction method in which the upper parts of the hopper assembly are constructed first down to the base, which is constructed last.

Figure 22:
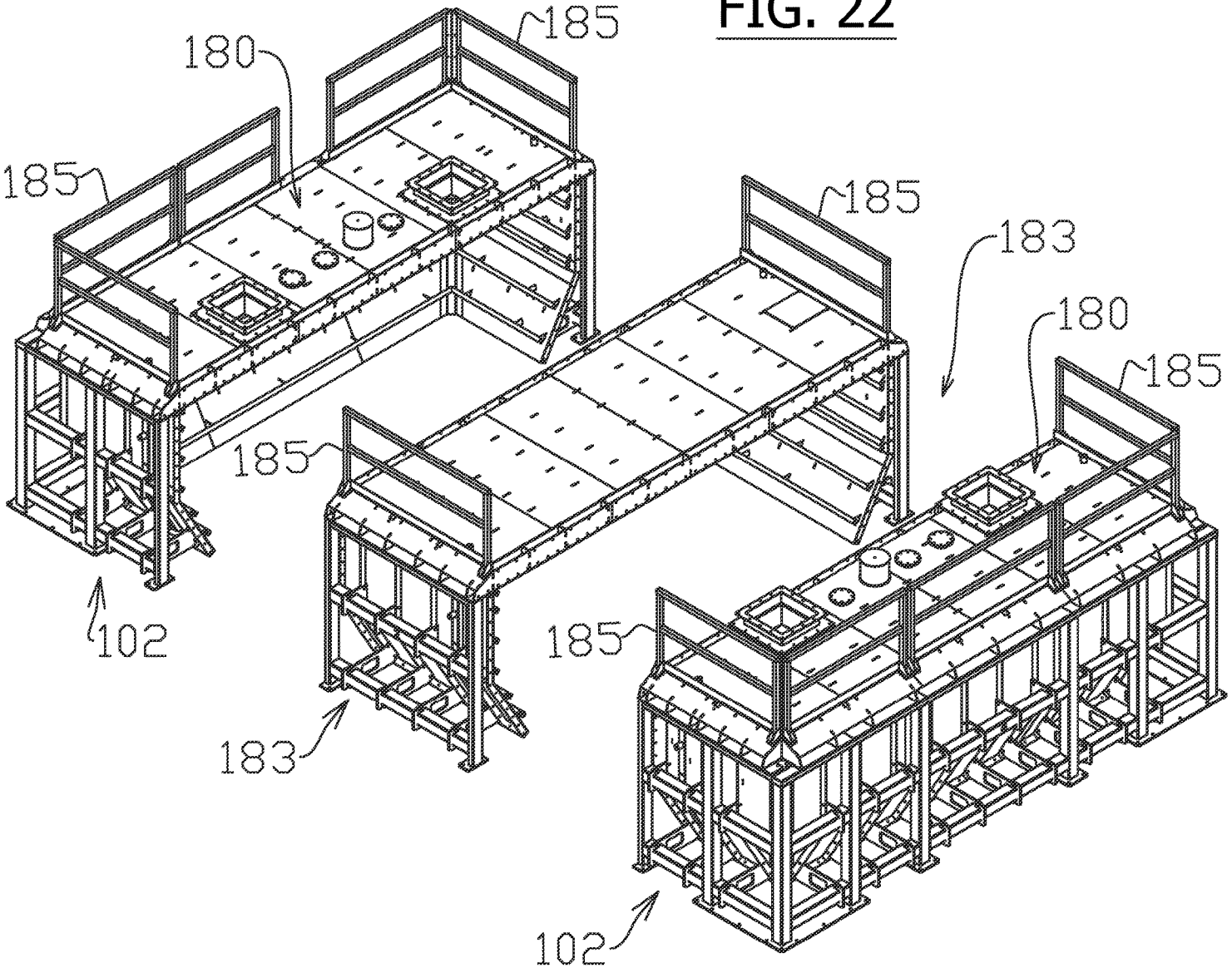
FIG. 22 is a perspective view of the side and central roof units attached to the upper hopper units where the upper hopper units are separated from each other.
Figure 23:
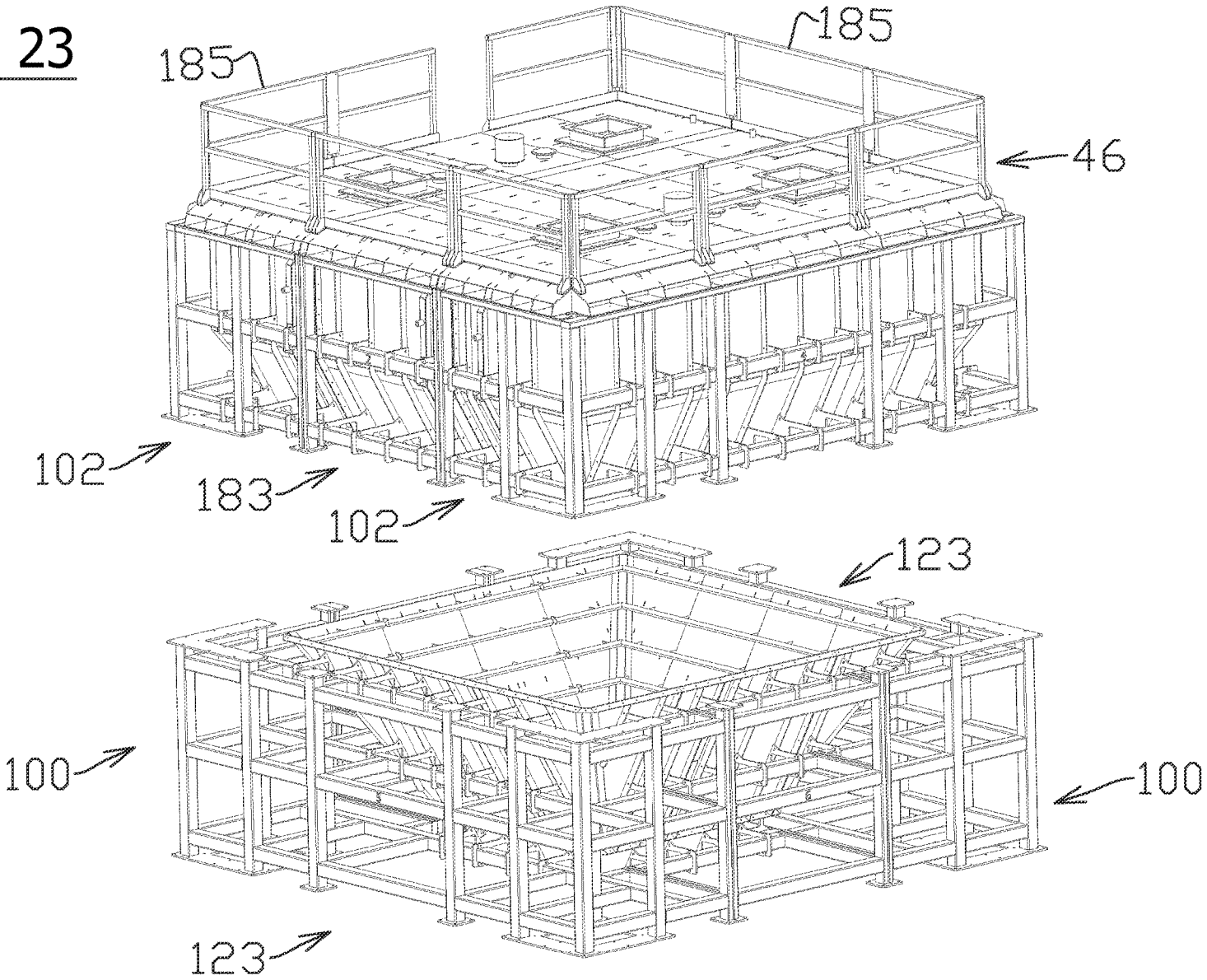
FIG. 23 is a perspective view of the upper hopper units with the side and central roof units of FIG. 22 aligned with the middle hopper units.

Assembly or construction of the embodiment of the hopper assembly 40 shown in FIG. 1 initially includes lifting the side roof units 180 using a suitable machine, such as a 10,000 pound capacity extended reach forklift, and placing the side roof units on the top of the upper hopper units 102 as shown in FIG. 22. Similarly, the central roof unit 182 is lifted and placed on opposing central walls 183 of the upper hopper units 102, where the central walls 183 are constructed as described above for the upper hopper units. The roof units 180, 182 are secured to the upper hopper units 102 and the central walls by bolts, washers and nuts or with any suitable connectors. The upper hopper units 102 are then attached together as shown in FIG. 23 by similar connectors to form the upper structure of the hopper assembly 40. A railing 185 is attached to the roof structure 46, and any equipment, such as an air blower or vacuum generator, is placed on and secured to the roof structure while the working height of the hopper assembly 40 is safe and easy to access. It should be appreciated that the railing 185 and any other equipment may be secured to the roof structure before or after the roof structure and upper hopper units are assembled together.

Next, two or more high capacity forklifts each with 45,000 to 55,000 pound lifting capacity, are positioned on opposing sides of the assembled upper hopper and roof units 102, 180, 182, and used to raise the above assembled structure to a designated height to accommodate the next level of the modular units of the hopper assembly 40. As shown in FIG. 23, the two middle hopper units 100 (FIG. 8) and two opposing middle wall units 123 constructed as shown in FIG. 18 and described above, are individually moved into position below the raised assembled structure including the upper hopper units and roof units, using conventional forklifts, such as forklifts having 5,000 pound lifting capacity. The middle hopper units 100 and the middle wall units 123 are attached together using connectors, such as bolts, washers and nuts, or other suitable connectors, to form the middle structure of the hopper assembly 40. The upper structure is aligned with the middle structure and then the upper structure is lowered onto the middle structure and connected together using suitable connectors as described above.

Figure 24:
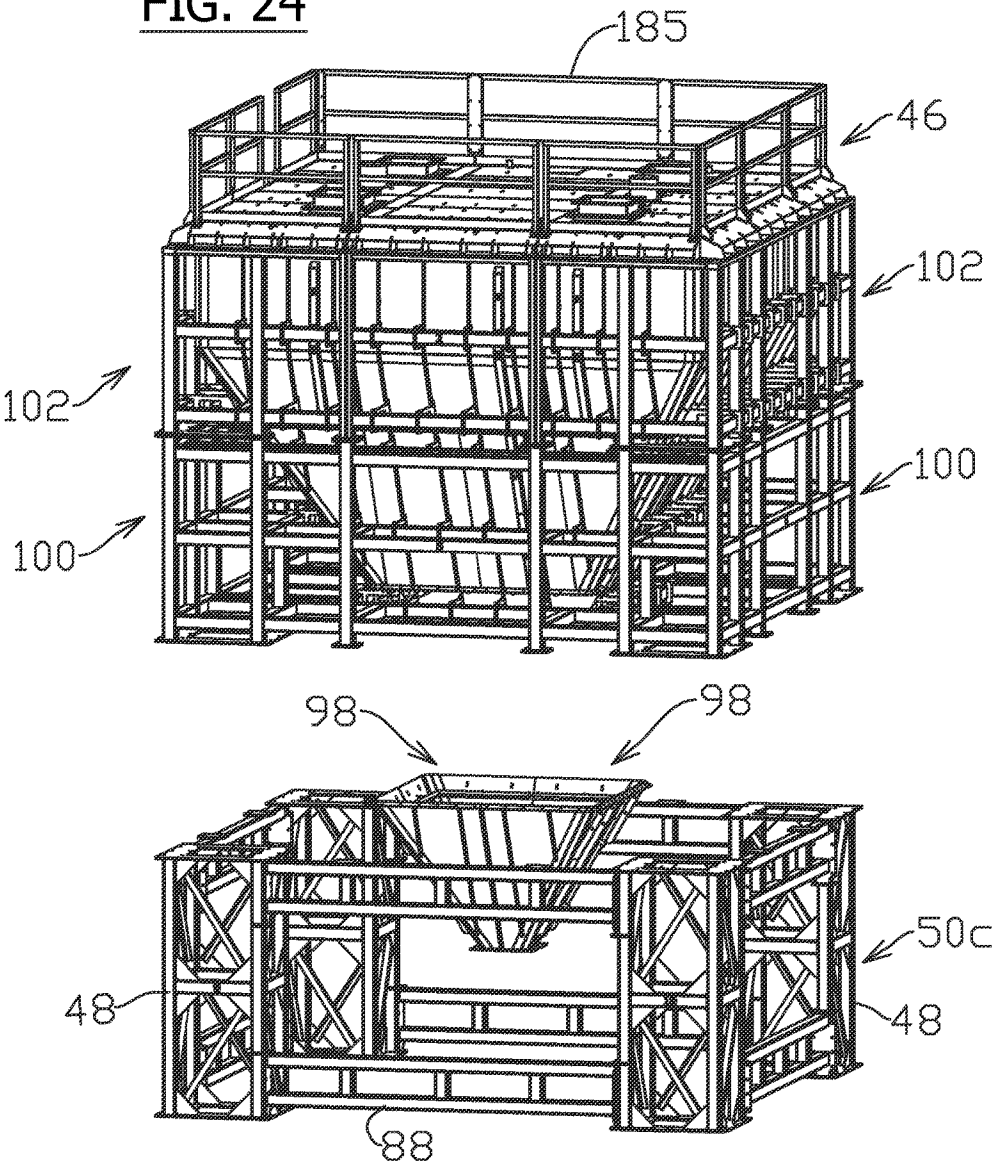
FIG. 24 is a perspective view of the upper hopper units and the middle hopper units attached to each other and aligned with the lower hopper units and underlying base.
Figure 25:
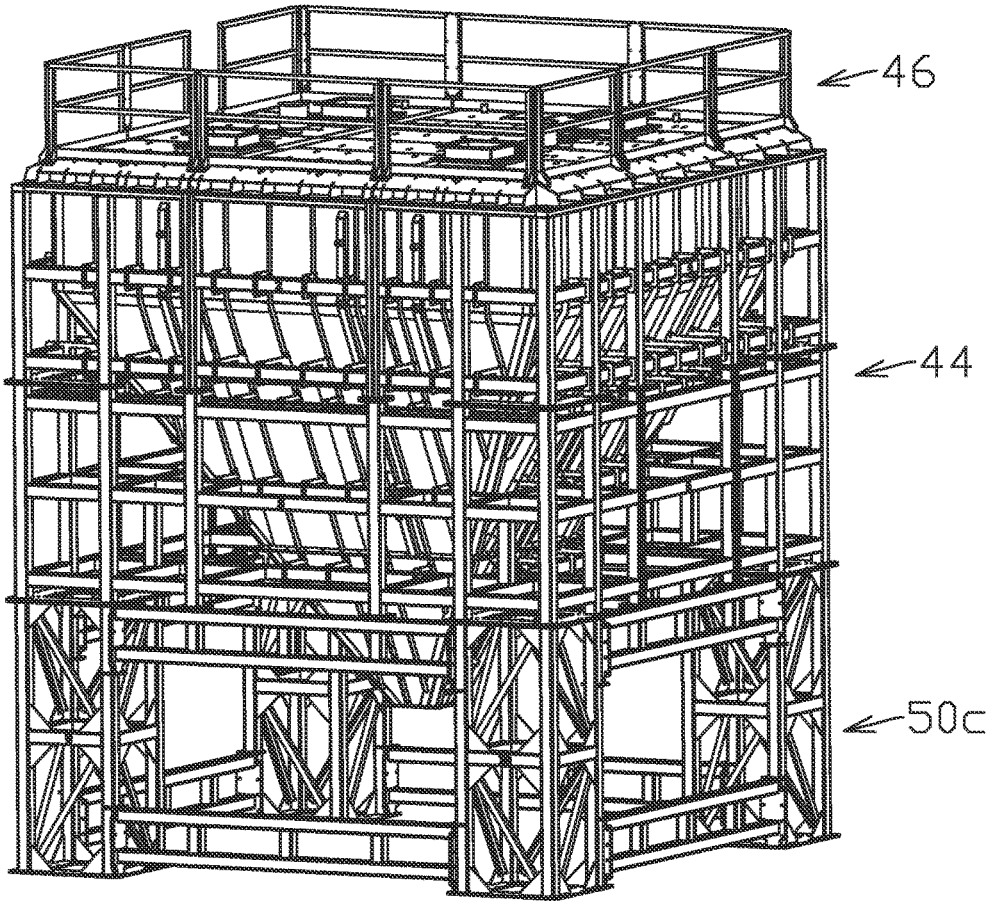
FIG. 25 is a perspective view of the upper hopper units, the middle hopper units and the lower hopper units attached to each other and aligned with a base unit of the base.
Figure 25:
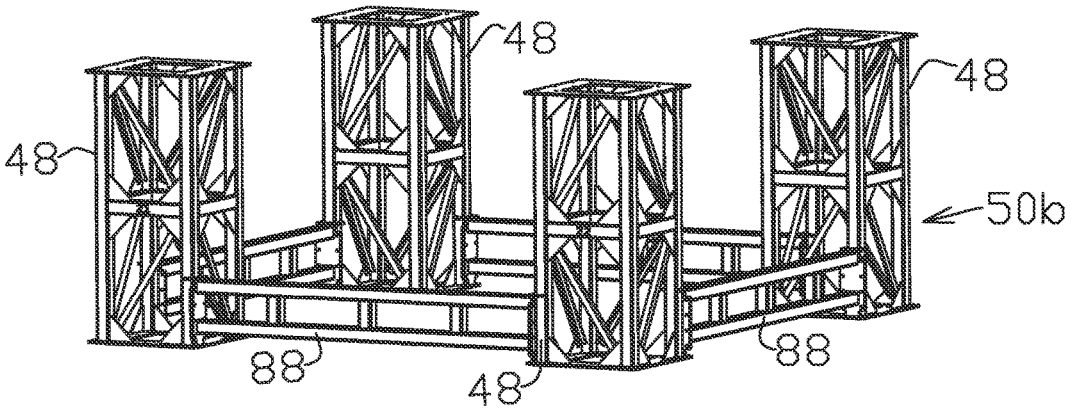

After the upper structure is secured to the middle structure, the assembled upper and middle structures are raised to a designated height by forklifts or similar equipment as described above. Next, the assembled lower hopper units 98 are aligned with and connected to the bottom of the portion of the middle hopper units 100 using connectors, such as bolts, washers and nuts. Also, one of the base units 50, namely the third base unit 50*c* in this embodiment, is assembled and positioned under and aligned with the assembled upper and middle structures. The assembled upper and middle structures are then lowered onto the upper surface of the third base unit 50*c* and connected to the third base unit using suitable connectors, as shown in FIGS. 24 and 25.

Figure 21:
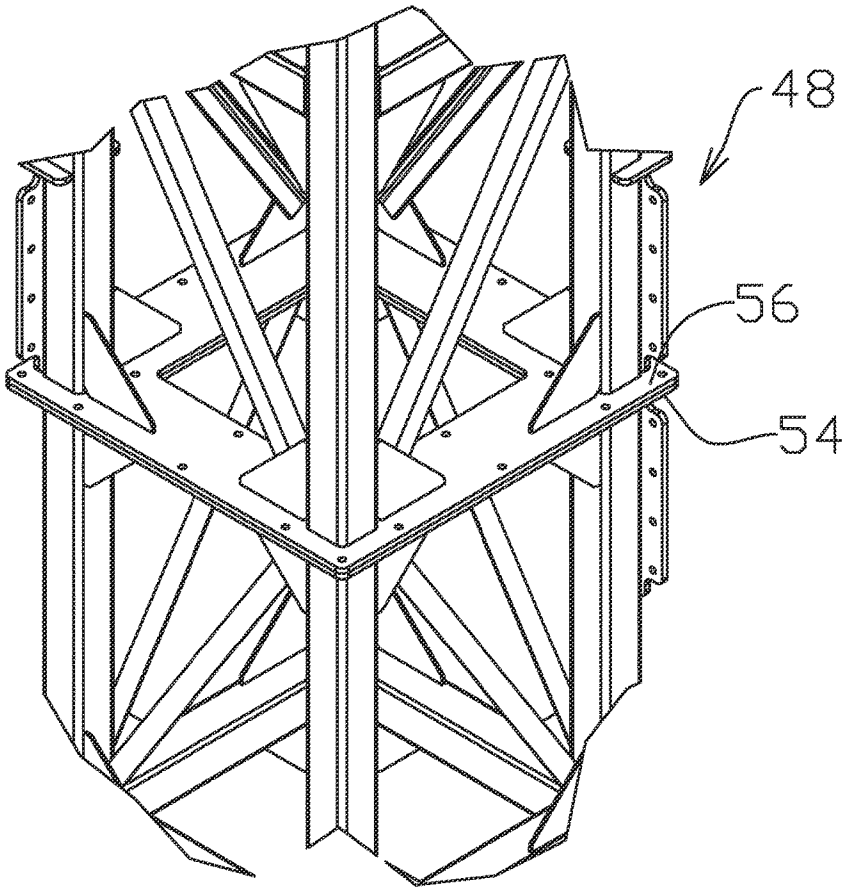
FIG. 21 is an enlarged, fragmentary perspective view the support members of FIG. 20.
Figure 20:
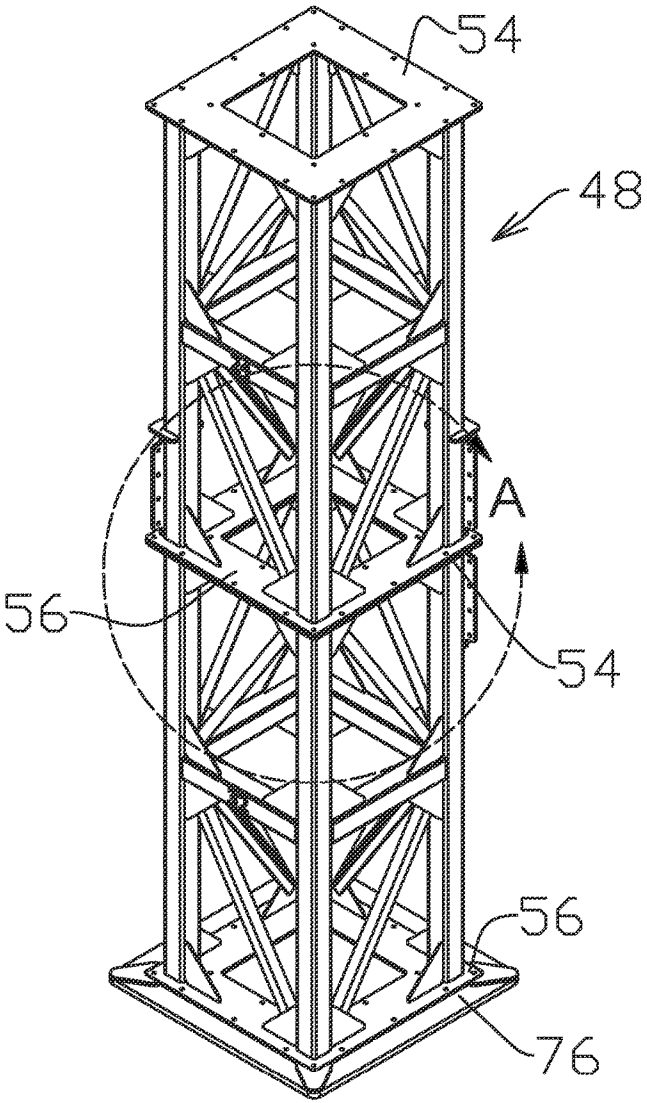
FIG. 20 is a perspective view of connectors for the support members of the base shown in FIG. 1.

In this embodiment, the base 42 includes three base units 50*a*, 50*b* and 50*c* to raise the hopper 40 to a desired height. It should be appreciated that one or a plurality of the base units 50 may be assembled and used in the hopper assembly 40 depending on the desired final height of the hopper. As shown in FIG. 25, the second base unit 50*b* is assembled and positioned under the third base unit 50*c* attached to the upper and middle structures. Once aligned, the assembled structure is lowered onto and connected to the upper surface of the second base unit 50*b* using suitable connectors. Next, the assembled structure including the upper and middle structures and the second and third base units 50*b*, 50*c* is raised to a designated height and four of the base support members 48 are positioned at respective corners of the assembled structure. The assembled structure is then lowered onto the four base support members 48. As shown in FIGS. 20 and 21, the support members 48 of the base units 50 each include planar upper and lower plates 54 and 56 that are easily aligned and connected to the upper and/or lower plates 54 and 56 of an adjacent support member using suitable connectors. Further, the lower plates 56 of the support member 48 of the base unit 50*c* are attached to base plates 76. After the support members 48 are connected to the assembled structure and the base plates 76, the base plates on the bottom support members 48 are secured to the floor or ground of the site by connectors such as bolts. After being secured to the floor or ground, the construction of the hopper assembly 40 is complete as shown in FIG. 1.

In the above embodiment, the modular units of the modular hopper assembly 40 are configured to be independent structures that may be shipped, handled and positioned easily at a site. To achieve this, the modular units do not have individual flange components, such as on a support member 48, so that the support members 48 are unitized into a singular flange connection. As such, the fabrication of the modular units is easier and faster than conventional hoppers, and easier to handle and transport to a site.

Furthermore, the structural members of the modular units do not have any angular cuts. Instead, the cuts made in the structural members are all at an angle of ninety degrees, which makes processing and assembly quicker and less expensive than complex cuts. Also as described above, welding of the modular units is performed in the pre-fabrication process at a manufacturing location and not at a designated assembly site, which helps to reduce material and labor costs and enable the hopper assembly to be assembled quickly and efficiently.

In the above embodiment, the support members and other structural components of the modular units of the hopper assembly 40 are first assembled into the modular units and then primed and painted. Completing the assembly, priming and painting of the modular units at a manufacturing site before shipment to a site or sites, save significant time and costs associated with shipping and assembly of the modular hopper assembly 40. Furthermore, the assembly process may be reversed if the hopper assembly 40 needs to be disassembled and moved to another location, which saves time and costs.

While particular embodiments of the present hopper assembly are shown and described, it will be appreciated by those skilled in the art that changes and modifications may be made thereto without departing from the invention in its broader aspects and as set forth in the following claims.

What is claimed is:

1. A modular hopper assembly comprising:

an upper hopper including two pre-fabricated upper hopper modular units that are attached together;

a middle hopper including two pre-fabricated middle hopper modular units that are attached together, wherein the middle hopper is attached to the upper hopper;

a lower hopper including two pre-fabricated lower hopper modular units that are attached together and attached to the middle hopper, wherein the two pre-fabricated lower hopper modular units each include at least two air supply devices that are spaced vertically from each other and extend along inner surfaces of the pre-fabricated lower hopper modular units transverse to a longitudinal axis of the lower hopper; and a plurality of support members configured as a base, wherein the upper hopper modular units, the middle hopper modular units and the lower hopper modular units are each assembled together to respectively form the upper hopper, the middle hopper and the lower hopper, and then the assembled upper hopper, the assembled middle hopper and the assembled lower hopper are connected together to form a hopper, and wherein the hopper is mounted on the base.

2. The modular hopper assembly of claim 1, wherein at least one of the upper hopper modular units, the middle hopper modular units and the lower hopper modular units, each include a frame and panels connected to the frame.

3. The modular hopper assembly of claim 2, wherein the panels connected to the frame are positioned at an angle of sixty degrees relative to a central longitudinal axis of the at least one of the upper hopper modular units, the middle hopper modular units and the lower hopper modular units.

4. The modular hopper assembly of claim 2, wherein the frame includes a plurality of spaced tabs and the panels include a plurality of spaced slots corresponding to the tabs, wherein the tabs are inserted into and secured to the corresponding slots on the panels when the panels are placed on frame.

5. The modular hopper assembly of claim 2, further comprising a plurality of the air supply devices attached to inner surfaces of the panels of at least one of the upper hopper modular units, the middle hopper modular units and the lower hopper modular units, wherein the air supply devices automatically clean the inner surfaces of the panels.

6. The modular hopper assembly of claim 1, wherein the base includes at least two base units, each of said at least two base units including a plurality of the support members, each of the support members including a support body and an upper plate and a lower plate attached to opposing ends of the support body.

7. The modular hopper assembly of claim 1, further comprising a roof structure mounted on the upper surfaces of the upper hopper modular units, said roof structure extending across the upper surfaces of the upper hopper modular units.

8. The modular hopper assembly of claim 7, wherein the roof structure includes a plurality of pre-fabricated side roof units and at least one pre-fabricated central roof unit that are assembled together.

9. A method of assembling a modular hopper assembly at a site, the method comprising:

assembling two pre-fabricated upper hopper modular units as an assembled upper hopper structure;

assembling two pre-fabricated middle hopper modular units as an assembled middle hopper structure;

assembling two pre-fabricated lower hopper modular units as an assembled lower hopper structure;

assembling a plurality of support members as a base unit; and connecting the assembled upper hopper structure, the assembled middle hopper structure and the assembled lower hopper structure to form a hopper, and mounting the hopper on the base unit.

10. The method of claim 9, wherein at least one of the upper hopper modular units, the middle hopper modular units and the lower hopper modular units, each include a plurality of panels connected to a frame.

11. The method of claim 10, wherein the panels are connected to the frame at an angle of sixty degrees relative to a central longitudinal axis of the at least one of the upper hopper modular units, the middle hopper modular units and the lower hopper modular units.

12. The method of claim 10, wherein connecting the panels to the frame includes aligning and inserting a plurality of spaced tabs on the frame with a plurality of spaced slots on the panels.

13. The method of claim 10, further comprising attaching a plurality of air supply devices to inner surfaces of the panels of at least one of the upper hopper modular units, the middle hopper modular units and the lower hopper modular units, wherein the air supply devices automatically clean the inner surfaces of the panels.

14. The method of claim 13, further comprising connecting the air supply devices to pressurized air and directing the pressurized air from openings in the air supply devices on the inner surfaces of the panels.

15. The method of claim 9, further comprising mounting a roof structure on upper surfaces of the upper hopper modular units.

16. The method of claim 15, further comprising assembling a plurality of pre-fabricated side roof units and at least one pre-fabricated central roof unit assembled together to form the roof structure.

* * * * *